US011980787B2

(12) United States Patent
Gisin et al.

(10) Patent No.: US 11,980,787 B2
(45) **Date of Patent: *May 14, 2024**

(54) REPOSITIONING POINT OF ACTUATION FOR AN EXERCISE APPLIANCE

(71) Applicant: Tonal Systems, Inc., San Francisco, CA (US)

(72) Inventors: Yevgeniy Mikhaylovich Gisin, San Leandro, CA (US); Michael Valente, San Francisco, CA (US); David Jonathan Zimmer, Exeter, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/125,039

(22) Filed: Mar. 22, 2023

(65) Prior Publication Data

US 2023/0381567 A1 Nov. 30, 2023

Related U.S. Application Data

(63) Continuation of application No. 17/146,168, filed on Jan. 11, 2021, now Pat. No. 11,642,561, which is a (Continued)

(51) Int. Cl.
*A63B 21/00* (2006.01)
*A63B 21/04* (2006.01)
(Continued)

(52) U.S. Cl.
CPC .... *A63B 21/00072* (2013.01); *A63B 21/0442* (2013.01); *A63B 21/0626* (2015.10); (Continued)

(58) Field of Classification Search
CPC ..... A63B 21/00072; A63B 22/205; A63B 21/4035; A63B 21/0626; A63B 21/0442; (Continued)

(56) References Cited

U.S. PATENT DOCUMENTS 4,898,381 A 2/1990 Gordon
5,700,232 A 12/1997 Clausen
(Continued)

FOREIGN PATENT DOCUMENTS

CA 2850734 12/2014
WO 9842411 10/1998

OTHER PUBLICATIONS

Drive Interactive, Jan. 10, 2018, downloaded from: https://web.archive.org/web/20180110113644/https://driveinteractive.com/.

*Primary Examiner* — Andrew S Lo
(74) *Attorney, Agent, or Firm* — Van Pelt, Yi & James LLP

(57) ABSTRACT

An exercise machine comprises an arm support, including: a carriage configured to slide within a track attached to the exercise machine; and a support assembly that floats the carriage relative to the track, wherein the support assembly is disengaged by the application of force via the arm. An exercise machine comprises a rotatable column, wherein the column supports an arm, and a gear detent mechanism to support a discrete number of positions for the rotatable column. An exercise machine comprises a tiltable arm, and a mechanism to support a discrete number of positions for the tiltable arm.

15 Claims, 30 Drawing Sheets

Related U.S. Application Data continuation of application No. 16/370,377, filed on Mar. 29, 2019, now Pat. No. 10,918,899.

(60) Provisional application No. 62/650,130, filed on Mar. 29, 2018, provisional application No. 62/650,139, filed on Mar. 29, 2018, provisional application No. 62/650,146, filed on Mar. 29, 2018.

(51) Int. Cl.
*A63B 21/062* (2006.01)
*A63B 22/20* (2006.01)

(52) U.S. Cl.
CPC ..... *A63B 21/155* (2013.01); *A63B 21/159* (2013.01); *A63B 21/4035* (2015.10); *A63B 22/205* (2013.01); *A63B 2210/50* (2013.01)

(58) Field of Classification Search
CPC . A63B 21/159; A63B 21/155; A63B 2210/50; A63B 21/4043; A63B 2225/50; A63B 2071/0655; A63B 2225/093; A63B 21/4047; A63B 21/4045; A63B 21/156; A63B 21/015; A63B 24/0087; A63B 22/00–0007; A63B 22/0012; A63B 23/035–03516; A63B 23/12; A63B 69/38; A63B 69/0024; A63B 69/0071; A63B 69/0002; A63B 69/36; A63B 69/0046; A63B 21/0628; A63B 23/03508; A63B 23/03525; A63B 23/03541; A63B 2208/0233; A63B 2069/0006; A63B 65/00; A63B 2208/0204; A63B 2069/0008; A63B 2208/0242; A63B 69/3611; A63B 69/0079
See application file for complete search history.

(56) References Cited

U.S. PATENT DOCUMENTS 6,402,711 B1 6/2002 Nauert
6,447,430 B1 9/2002 Webb
6,926,094 B2 8/2005 Arntson
7,169,093 B2 1/2007 Simonson
8,002,236 B2 8/2011 Myers
8,057,368 B1 11/2011 Lyszczarz
8,465,400 B1 6/2013 Batca
8,708,872 B2 4/2014 Giannelli
8,827,877 B2 9/2014 Giannelli
8,834,328 B1 9/2014 Batca
9,067,100 B2 6/2015 Habing
9,211,434 B2 12/2015 Giannelli
9,656,116 B2 5/2017 Giannelli
9,707,436 B1 7/2017 Atwood
9,968,819 B2 5/2018 Hockridge
10,016,646 B2 7/2018 Butler
10,335,626 B2 7/2019 Orady
10,350,445 B2 7/2019 Hockridge
10,441,840 B2 10/2019 Dalebout
10,556,144 B2 2/2020 Habing
2001/0023221 A1 9/2001 Simonson
2003/0134722 A1 7/2003 Greenland
2003/0176261 A1 9/2003 Simonson
2004/0157711 A1 8/2004 Regev
2004/0262020 A1 12/2004 Arntson
2006/0260689 A1 11/2006 Myers
2007/0037674 A1 2/2007 Finn
2007/0161472 A1 7/2007 Drechsler
2007/0173384 A1 7/2007 Sechrest
2008/0051263 A1 2/2008 Rasmussen
2008/0300116 A1 12/2008 Eder
2012/0225760 A1 9/2012 Webb
2013/0065737 A1 3/2013 Habing
2013/0184128 A1 7/2013 Towley, III
2013/0274075 A1 10/2013 Habing
2013/0296144 A1 11/2013 Gvoich
2014/0121071 A1 5/2014 Strom
2015/0182780 A1 7/2015 Olson
2015/0246258 A1 9/2015 Hockridge
2015/0321048 A1 11/2015 Ross
2016/0121156 A1 5/2016 Bach
2016/0250514 A1 9/2016 Gvoich
2017/0173380 A1 6/2017 Bach
2017/0326407 A1 11/2017 Johnson
2018/0221701 A1 8/2018 Hockridge
2019/0099632 A1 4/2019 Orady
2019/0262652 A1 8/2019 Orady
2019/0336812 A1 11/2019 Leipheimer
2020/0047027 A1 2/2020 Ward
2020/0047030 A1 2/2020 Ward
2020/0047031 A1 2/2020 Orady
2020/0047053 A1 2/2020 Ward
2020/0047054 A1 2/2020 Ward
2020/0047055 A1 2/2020 Ward
2020/0054929 A1 2/2020 Ward
2020/0139187 A1 5/2020 Kennington Right View Front View Isometric View Bottom View Top View Column (empty)

Column With Seated Carriage

Back View

Left View

REPOSITIONING POINT OF ACTUATION FOR AN EXERCISE APPLIANCE

CROSS REFERENCE TO OTHER APPLICATIONS

This application is a continuation of U.S. patent application Ser. No. 17/146,168, entitled REPOSITIONING POINT OF ACTUATION FOR AN EXERCISE APPLIANCE filed Jan. 11, 2021 which is incorporated herein by reference for all purposes, which is a continuation of U.S. patent application Ser. No. 16/370,377, now U.S. Pat. No. 10,918,899, entitled REPOSITIONING POINT OF ACTUATION FOR AN EXERCISE APPLIANCE filed Mar. 29, 2019 which is incorporated herein by reference for all purposes, which claims priority to U.S. Provisional Patent Application No. 62/650,130 entitled SUPPORT CARRIAGE FOR LOAD ARMS OF AN EXERCISE APPLIANCE filed Mar. 29, 2018 which is incorporated herein by reference for all purposes, and claims priority to U.S. Provisional Patent Application No. 62/650,139 entitled EXERCISE MACHINE COLUMN LOCK filed Mar. 29, 2018 which is incorporated herein by reference for all purposes, and claims priority to U.S. Provisional Patent Application No. 62/650,146 entitled EXERCISE MACHINE ARM LOCK filed Mar. 29, 2018 which is incorporated herein by reference for all purposes.

BACKGROUND OF THE INVENTION

Exercise machines are usually bulky, configured once at set-up and then rarely changed except for alterations of the load or resistance elements. Fixed systems often comprise a gantry with accessory components attached in defined ways and, though these systems may be reconfigured, this is often a laborious process involving removable fasteners and tools. Single function machines are common but are often inconvenient and/or expensive for home use, so are more typically found in gymnasia or shared facility exercise rooms.

BRIEF DESCRIPTION OF THE DRAWINGS

Various embodiments of the invention are disclosed in the following detailed description and the accompanying drawings.

DETAILED DESCRIPTION

Figure 1:
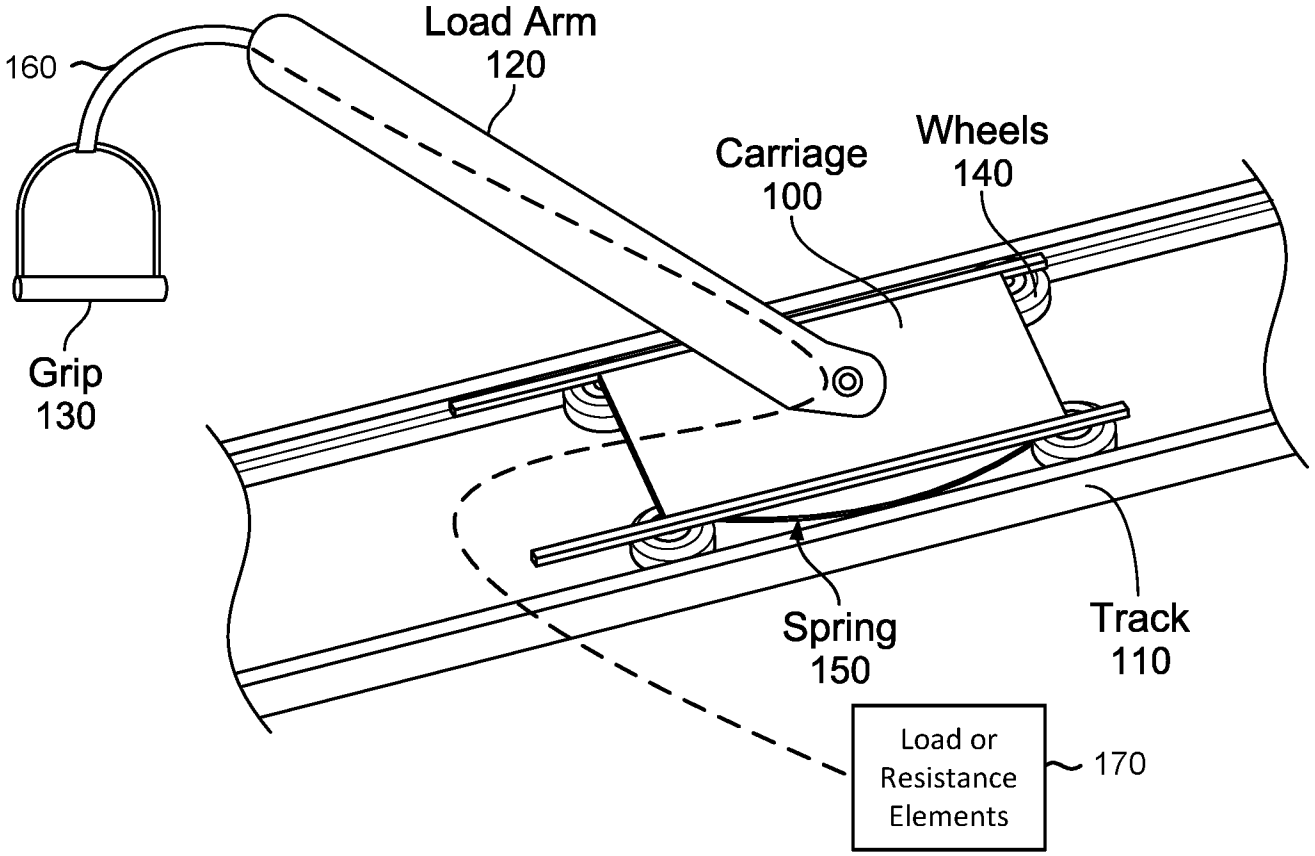
FIG. 1 is an illustration of an embodiment of a carriage assembly.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Traditionally there are examples of single multi-function exercise machines in applications like strength training, but these are generally set up for a single user and require configuration changes to adjust the load or resistance in fixed steps as well as pulley positions for changing the user. Often, multiple pulleys are preset for position and the coupling to a user load-point/actuator, such as a grip or handle, connected to the load elements at the time of use. For example, arm exercises may use one pulley set and leg exercises may use a different pulley set.

The cables or lines used by the participant may be connected to load elements using links which may be selected for efficient/quick connection. Load elements in these traditional machines may be weights, springs or some combination of these two. A load element may also be a digital strength trainer using a motor in some way. In some appliances, spring mechanisms comprised of beams fashioned like a longbow and resistance or load are added by simply connecting two or more of these beams together.

Instead of using multiple pulley systems, it may be practical to make pulleys that guide the load path easily relocatable to accommodate positioning for different exercises. Lines and/or cables that carry the load, permanently connected to a load or resistance device, and a repositionable load arm/mechanism placing a grip at the point where a user needs it is disclosed. As part of making this effective, repositioning is simple, requiring no great skill or effort. Another part of making this effective involves securing position regardless of load and requiring little or no maintenance by the user. Another part of making this effective comprises provision for reducing and/or preventing inadvertent movement of the load arms because of the potential for user injury.

Support Carriage along a Load Arm. In one embodiment, an exercise machine comprises a load element, a column, a carriage configured to engage with the column and travel along the column, and a load arm supported by the carriage providing a load path along which a cable is routed from the load element to an actuator wherein the load arm is positioned with at least three degrees of freedom by movement of the carriage along the column, rotation of the column, and tilting of the arm.

The column may be designed to be oriented in a substantially vertical direction when the exercise machine is mounted. The column comprises a track. The load arm may include a pulley to route the cable. The carriage may include a support assembly that floats the carriage relative to the column and supports the carriage when the carriage is under load. The carriage may support the arm translating vertically along the column. The carriage may include a support assembly that includes wheels and springs.

The carriage may include a support assembly that includes wheels and springs wherein the springs comprise spring plates. The carriage may include a support assembly that includes wheels and springs wherein the springs comprise spring plates and wherein the spring plates engage to cause the wheels to engage the column in the absence of an external force being applied to the arm. The carriage may include a support assembly that includes wheels and springs wherein the springs comprise spring plates and wherein the spring plates engage to cause the wheels to engage the column in the absence of an external force being applied to the arm.

In one embodiment, a sagittal gear on the carriage enables tilting of the arm at discrete angles. A remote control enabled solenoid that locks rotation of the column may also be included. A second load arm may also be included. Movement of the carriage may be indexed by an index pin. The carriage may include a sagittal gear that includes teeth and a locking member that engages the teeth. The carriage may include a sagittal gear that includes teeth and a locking member that engages the teeth and wherein the load arm includes a handle that when pulled, causes the locking member to be disengaged from the sagittal gear, enabling the arm to tilt vertically.

In one embodiment, the exercise appliance passes the load/resistance against which the user exercises via a line/cable to a grip or grips that a user displaces in order to exercise. The grip may be positioned relative to the user using a load arm and the load path is steered using pulleys at the load arm. The load arm may be connected to the exercise appliance frame using a carriage that moves within a track that is affixed to the main part of the frame, which is firmly attached to a rigid structure. This firm attachment may be to a gantry, wall or other permanent structure. In one embodiment, the exercise appliance comprises one or more load arms from which the cable extends, each arm being between 2 and 5 feet long, for example 3 feet long, made of rigid material, for example steel, and may weigh up to 25 lbs, for example 10 lbs.

In one embodiment, in use the load arm is pivoted to the required angle relative to the track. This angular position may be one of several preselected positions. Once an angle is chosen, a locating peg may retain position of the arm. The carriage that locates the appliance end of the load arm may now be moved to select the position of the grip relative to the user, for example movement up or down. An appliance may have two load arms that may be positioned independently corresponding to right and left limbs of the user.

In one embodiment, the carriage is designed with slots that closely engage the matching ways on the track. Unlike applications in the machining arts, this may not necessarily be a precision fit; the carriage lacks adjustable gibs that are responsible for minimizing play in the movement between the carriage and the track, as such gibs may add additional weight, complexity and/or cost. When the carriage is unloaded, carrying only the residual load due to the weight of the load arm and its component parts, the engagement between the carriage and the track may be minimized to reduce sliding friction between the two components. In one embodiment, a set of spring-loaded wheels are attached to the carriage and engaged with the ways of the track so that the carriage rolls freely. This may permit easy relocation of the load arm position.

In one embodiment, a load transfer is enabled using low-tolerance, non-hardened, and non-machined components, for example using an aluminum track with or without hardened steel inserts into which large moment loads may be passed. Traditionally, such a high load connection is accomplished using high-precision, high-hardness, machined components which increase weight and expense and may be inefficient economically. A high-tolerance fit may also require the use of lubrication and other maintenance overhead which enables close-fitting parts to smoothly interact without jamming. For example, lathe carriages require lubrication, costly/precise manufacturing techniques and are heavy and expensive. This lubrication may be undesirable because it may gather dust/debris and dirty the user of the machine. An alternate approach in traditional machines is to manufacture with lower tolerances, but for high-load-bearing systems the results of this lower tolerance manufacturing may also be undesirable. For example, such systems in known gym equipment are clunky, low-precision, and may not provide a positive "user feeling". The disclosed techniques combine the advantages of both of the known high- and low-tolerance approaches by being inexpensive, light, simple, and exhibiting good user feeling.

In one embodiment, when the carriage is loaded by forces applied to the load arm system, this causes a deflection of the carriage. This deflection may displace the wheels and creates intimate contact between the carriage slots and the track which, being un-lubricated, results in a high friction condition resisting movement along the track. In this condition, the wheels formerly the enabling factor in low resistance movement are instead forced against the track with a considerable side loading and the inwards component of this force may cause the spring system to deflect and the wheels to move inwards with enough compliance to allow the primary load to be borne by the carriage body alone. In one embodiment, a constraint on the spring assembly prevents and/or limits torsional bending of the spring and holds the wheels in their plane relative to the carriage.

In an exercise application, continuous variability in the position of the user load points may seem attractive, but in practice for repeatability of the exercise there is an improvement if this is limited to discrete steps. In one embodiment, this positional indexing is achieved by using a pin that is engaged with predefined holes in the track assembly. This serves a second purpose of enabling accurate and repeatable indexing of the carriage that supports the load arm as well as preventing accidental movement when the system is unloaded or very lightly loaded; for example if a small child were to play with the appliance, inadvertent movement may result in injury or damage.

Facilitating easy repositioning of a load arm carriage for an exercise appliance when minimally loaded/in a resting position whilst remaining immobile when further loaded is disclosed.

FIG. 1 is an illustration of an embodiment of a carriage assembly. A carriage assembly (100) is shown located in a track (110) along which it translates. Also shown is a load arm (120) and a user grip (130) located at the end of the arm by a cable or line (160) that passes over pulleys (not shown) into and along the interior of the track (110) and from there to the load or resistance elements (170) of the exercise appliance. In one embodiment, the load arm (120) is step adjustable in angle relative to the carriage and from there the track (110), in a plane at right angles to and parallel with the direction of translation of the carriage (100) along the track (110).

In one embodiment, the carriage (100) is equipped with wheels (140), supported by a spring assembly (150) so that each pair of wheels is attached to a plate having the properties of a spring, each of the two spring plates disposed to opposite sides of the carriage. The location of the wheels may be chosen so that in use they are pushed firmly against the track (110) by the spring which is securely retained by the carriage. The carriage may be supported by the wheel assembly so that in its unloaded state the support forces are reacted entirely through the wheels and the spring forces prevent lateral play in the carriage position.

In one embodiment, the retaining mechanism is selected to minimize torsional distortion of the spring which in turn causes the wheels to maintain their position in a plane to ensure that they can roll along the track (110). If the wheels experience excessive movement from this plane, then the wheel may scrub against the track (110) causing undesirable frictional forces and wear on the track (110).

Figure 2:
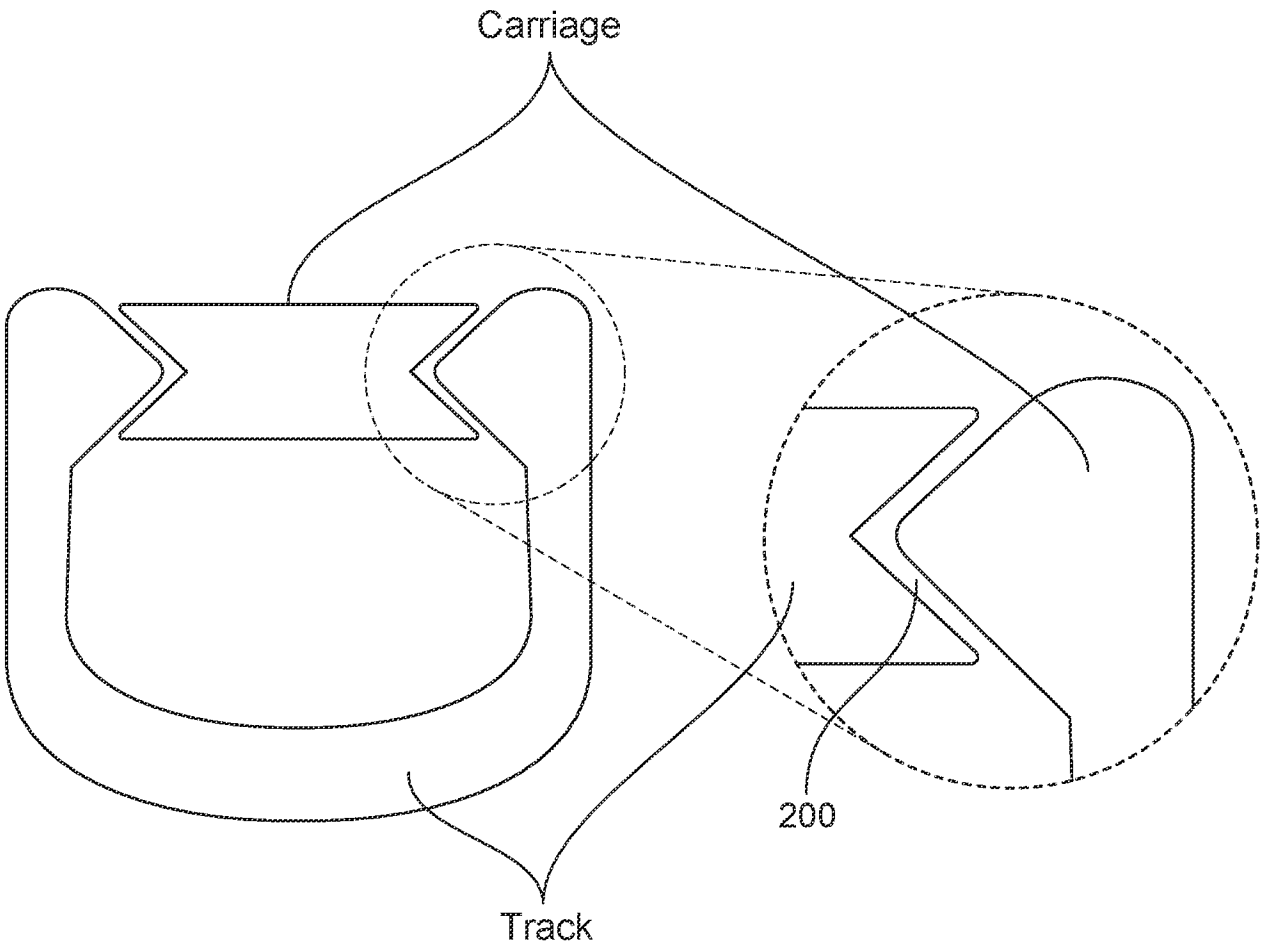
FIG. 2 is an illustration of an embodiment of a carriage platform.

FIG. 2 is an illustration of an embodiment of a carriage platform. In one embodiment, the carriage platform has grooves cut into the sides that locate it within the track. The included angle of both the track edges and the carriage grooves may be equal so that the carriage groove and the track are parallel. If the material from which the carriage is made and that from which the track is made are the same, then the clearance (200) between the carriage and the track may be relatively small. However when the materials differ, it may be important to consider the effects of temperature so that the carriage and track may be prevented from binding. Such binding may cause distortion of the track and subsequent rough operation of the mechanism.

In one embodiment, the track is made of an extruded 6061 Aluminum in the T6 temper. This is a tough alloy and may be used in its native color or may be treated to provide decorative aspects; for example a hard anodized and colored treatment provides an attractive finish and allows differentiation of models when optional configurations are available. Aluminum alloys have a benefit that they are considerably lighter than their steel counterparts and convenient to manufacture to finished dimensions without additional machining. In one embodiment, a chrome plated steel may be used.

In one embodiment, the carriage assembly is made of aluminum. Alternately, a steel carriage may also be used. Although steel is heavier than aluminum, steel has a wider plastic range, resists flexing better, and is also more abrasion resistant, so a steel carriage may be more durable. Steel is also compatible with the spring steel plates that may be used to attach the wheel structures and their retaining hardware. Further, the use of steel is compatible with the mechanical requirements for the attachment for the load arm and its adjustment components.

In one embodiment, a steel carriage assembly may be surface treated to reduce or prevent rusting and a variety of treatments are well known in the art. If an attractive surface is required, a nickel coating may be provided which is extremely hard. Alternatively, a chrome plating may be laid over a nickel bonding layer to give a very bright surface. A painted surface treatment may also be acceptable. In one embodiment, a powder coated finish has proven to be durable. In one embodiment, a chromated finish was proven to be durable. In one embodiment, a stainless steel carriage is passivated and durable.

A cover may be provided to restrict inadvertent access to the mechanism of the carriage, thus reducing the incidence of accidental injury occurring when fingers are inadvertently trapped during manipulation of the carriage and load arm. This cover may be fabricated and detailed so that it cosmetically attractive and blends well with the overall appearance of the machine.

For example, in one implementation the cover is made of hard anodized aluminum and matched to the finish coloration provided at the track assembly. In another implementation a plastic cover is formed and is aesthetically satisfactory; an injection molding achieves good dimensional qualities and allows decorative features such as branding information to be embedded in the part.

Figure 3A:
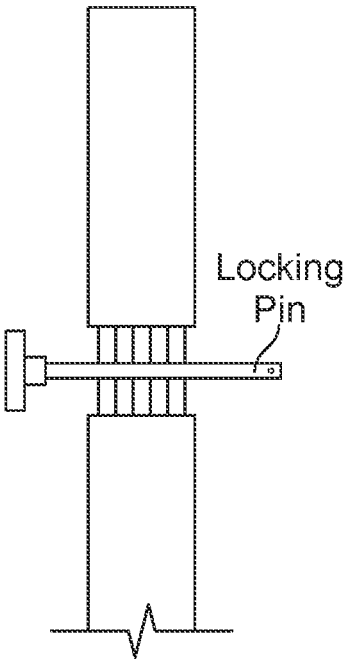
FIG. 3A is an illustration of an embodiment of a locking pin.
Figure 3B:
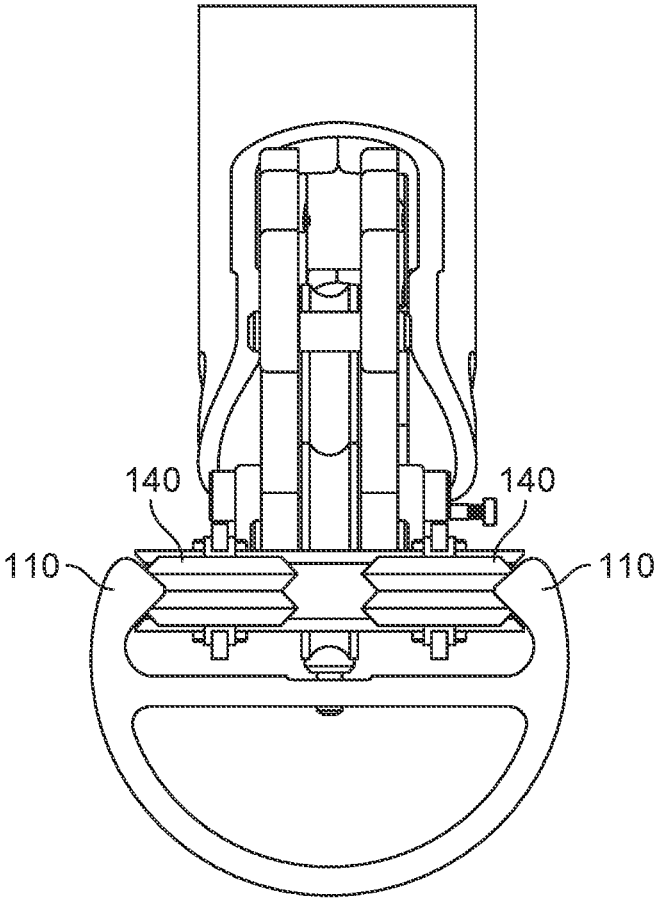
FIG. 3B is a cross-section of an embodiment of a carriage rail and carriage.

FIG. 3A is an illustration of an embodiment of a locking pin. FIG. 3B is a cross-section of an embodiment of a carriage rail and carriage. As shown in FIG. 3B, the wheels (140) run along the rail (110).

Figure 3C:
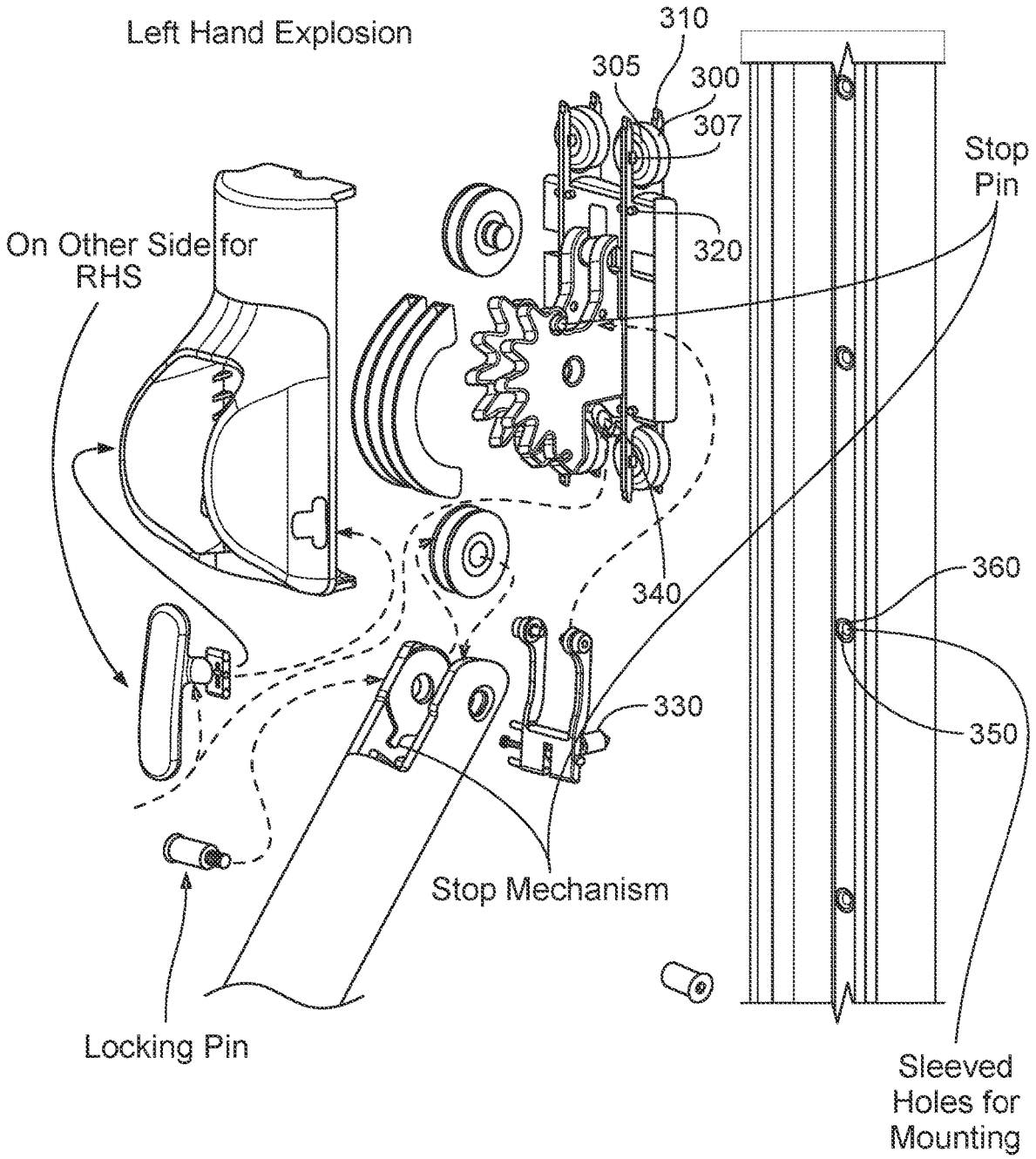
FIG. 3C is a high-level component assembly drawing for an embodiment of a carriage.

FIG. 3C is a high-level component assembly drawing for an embodiment of a carriage. As shown in FIG. 3C, the wheels (300) are fitted with a center bearing (305) and the spindle (307) that passes through the center of the bearing is forcibly engaged with a spring steel plate (310). By using the compliance of the spring material, slots in the spindle ends are pressed into the spring plate ends where they engage with matching dimples in the spring. The spindle is thus secured to the spring assembly and may require no further attention. The connection between the wheel (300) and the spindle (307) may be an axial-displacement-tight one to ensure that the wheel does not translate along the spindle (307).

This spring steel plate assembly, complete with its wheels, may then be attached to the carriage using locating pins (320). The carriage may have inner pins installed prior to the placement of the spring plate assembly. A single pin that protrudes through both upper and lower surfaces of the carriage plate to a height similar to the height of the spring steel component may be press fit into place. The pin may be a solid pin or a roll pin. The spring plate may have a slot cut that matches the carriage so that the spring plate fits closely over the carriage edge.

Once the spring steel plate (310) is slipped over the sides of the carriage, it may be secured in place by the outer pins which are then pressed into place. These retaining pins may also be solid pins or roll-pins and serve to locate the spring steel plate assembly with the wheels attached. The use of roll pins may be preferred if servicing is to be performed. By incorporating two sets of pins, an inner and an outer, close to both extremities of the carriage where the spring plates are located, the torsional effects of displacing the wheels by asymmetric loading may be best resisted and the wheels may only be free to displace inwards against the spring tension of the plate, along the plane in which they rotate, normal to the plane of the spring plate.

The outer set of pins (320) may prevent the complete spring assembly—spring steel plate (310) and wheel (300)—from rotating around its longitudinal axis with respect to the carriage. If this rotation were allowed, it may result in unintentional low-force displacement of the carriage into contact with the track. By preventing the axle or spindle of the wheel from twisting out of the plane of its intended orientation, progressive deterioration of the smooth movement of the carriage is avoided. By way of example, in the intended orientation the wheels roll along the track, but if they are allowed to twist out of this plane, then there is asymmetric loading that results in scraping friction of the wheel grooves against the edges of the track and/or the carriage making contact with the track at a much-too-low of an arm force, both of which may cause rapid wear, loss of smooth operation and noisy operation. The bearings (310) are preferably of a sealed type and may not require any routine maintenance over the life of the machine.

In operation, the carriage may be visualized for the sake of example to run vertically within a vertical track. In one particular application used, a pair of tracks run vertically on either side of the appliance. When the carriage is lightly loaded, the spring plates (310) may hold the wheels (300) sideways in intimate contact with the track. The carriage itself may be held away from the track, centered by the spring forces of the spring plates (310) that hold the wheels (300), so that the grooves on the carriage and the ways of the track are not in intimate contact. In this way, the carriage assembly is supported, relative to the track, by the sprung wheels (300) and there is minimal friction that prevents carriage motion. In this condition, because there is only rolling friction due to the wheel bearings (305) there may be a tendency for the unloaded carriage assembly to attempt to move down under gravity; supplementary loading due to the load cables that couple the grips that the user manipulates to the load or resistance device and stiction of their guiding pulleys may reduce this tendency.

Because there may be a need for accurate and repeatable placement, an index pin (330) may be inserted through a locating hole (340) in the carriage frame which pin may be pushed into preselected index holes (350) in the track base. This then has the locking effect that prevents inadvertent carriage movement coupled with a fixed, predetermined position. Because the pin is moved repeatedly in and out of the track locations, the track may be prone to wear in the neighborhood of the holes. This may be avoided by press-fitting abrasion resistant bushings into track that allow a long service life to be assured.

Pin (330) may be of small diameter and exhibit no great shear strength, nor is the carriage positioned to exert only shear loads on the pin as this would require a very close fit between the two elements—the carriage and the track—at the point where the shear force were to be applied and would be counter to an aim of easy movement of an unloaded carriage. Loads on the pin, if a close fit is not present, may have a substantial bending moment in addition to shearing forces in single shear and the implication of this is that, if this is the only restraining mechanism that prevents a loaded carriage from moving, then the bending force applied to the pin under load may cause the system to jam when a significant load is applied thus defeating the goal of easy operation.

Considering now a loaded condition, for the purposes of example and ease of visualization, the load arm may be assumed to be approximately horizontal and locked in that angular position relative to the carriage. A downward load at the extremity of the load arm may create a moment about the carriage causing the carriage to tilt slightly. With the track vertical, this implies that the top part of the carriage may be biased to move outwards and the lower part would move inwards. Because the carriage rides in the ways of the track, this means that the upper part of the carriage may be pressed hard against the inner shoulder of the way and the lower part may apply the same force against the outer shoulder of the way. This then results in a high friction force that prevents motion or translation along the track without any sizeable bending force being applied to the locating pin. Consequently the pin may be a comparatively loose fit, which further reduces any bending effects on the pin.

In this loaded condition, the large contact area of the high-load interface between carriage and track may allow for a high-moment coupling to be created using relatively soft materials, no lubrication, and low-precision manufacturing methods. Forces being applied to the extremity of a load arm during, for example, user exercises generate a high load. The length of the load arm may be much greater than that of the carriage, and even longer than the portion of the carriage that engages with the track during an exercise. For example, the load arm may be 36 inches long, versus, for example, less than 2 inches of the carriage being engaged with the track.

In this example, there may be a 20-fold moment arm difference that magnifies the forces generated at the extremity of the load arm, and transfers this magnified force to the carriage portion. For example, 100 pounds of force, such as an exercise load, being applied by the user at the extremity of a load arm may be magnified to 2000 pounds of force, a high moment, being applied to the load-bearing moment-reacting extremes of the carriage in contact with the track. Although this contact area may be much shorter than the length of the load arm, it may be long enough to distribute this high moment across a broad area of the track. This broad area enables the use of softer material for the track, for example, aluminum rather than steel.

The wheels (300) are the extremity of the carriage assembly at which the rolling forces exist for easy movement. The wheels (300) are supported by the spring plate (310) which is constrained to allow the wheels to move only laterally in their plane. Although a small amount of twisting may be present, this is negligible in a properly sized and restrained spring assembly. The wheels may have an approximately point contact with the track at the root of the groove in the wheel and the peak of the track. When a twisting force is applied to the carriage, this force may attempt to pull the upper wheels in this current example outwards from the track. The force may now be applied at the shoulder of the track and the matching shoulder on the wheel and this force may be resolved into a force parallel to the axle, which is reacted by the spring plate in its wide dimension and permits no movement, and a force in the plane of the wheel which is reacted by the spring plate and that allows the wheel to move inward in the plane of the wheel.

In the loaded condition, the forces acting on the wheel (300) may no longer be point contact forces but act along a line on the shoulder of the wheel as scraping friction. The bottom wheels behave in the same way except that the direction of force application is on the opposite shoulder because the wheel is being pushed inwards relative to the track. By way of simple example, consider the case where the included angle of both the track and the wheel groove is 90° corresponding to a half angle of 45° for the front and rear sides of the track respectively.

To accommodate a movement of the wheel of one millimeter outwards from the track, greatly exaggerated for this example, because the wheel is permitted no movement along its spindle normal to the track, it may be forced to displace by an equal one millimeter inwards against the spring force that holds it against the track. Because the wheels do not bear the high moment generated at the carriage during the loaded condition, they may be made of softer material, for example plastic or aluminum. Plastic wheels are quieter than metal ones when the carriage is being translated along the track.

As described above, loading the carriage causes a small twisting displacement of the carriage relative to the track that transfers a high exercise moment load into the track resulting in a large increase in friction forces between the carriage and the track which, in turn, strongly resist translation of the carriage along the track. Thus the locking pin plays only a minimal part in preventing translation when the carriage is loaded by forces that are applied at the arm and a close fit in the locating hole is not required.

In one embodiment, positioning is done using a spring-loaded ball that may be stepped along a series of dimples machined into the track base. In another, a sprung pawl that engages with a ratchet element such as a saw-toothed strip may be used. In both of these implementations a simple mechanism may be used to reduce any engagement forces and relieve the ball or pawl pressures so that noise as the steps are sequentially engaged may be reduced.

Figure 4A:
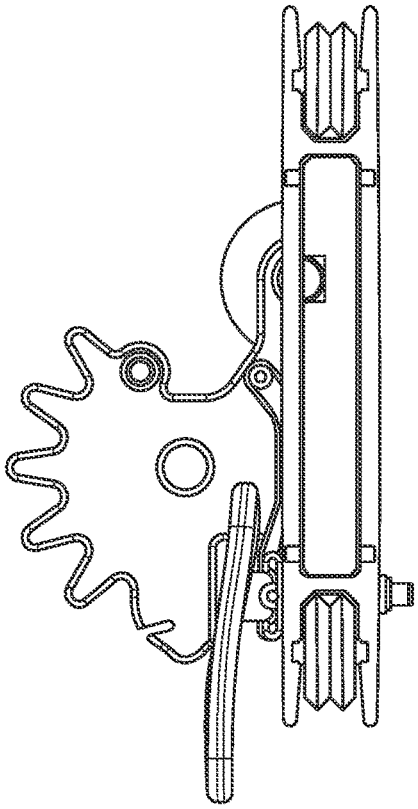
FIG. 4A illustrates several views for an embodiment of a carriage.
Figure 4A:
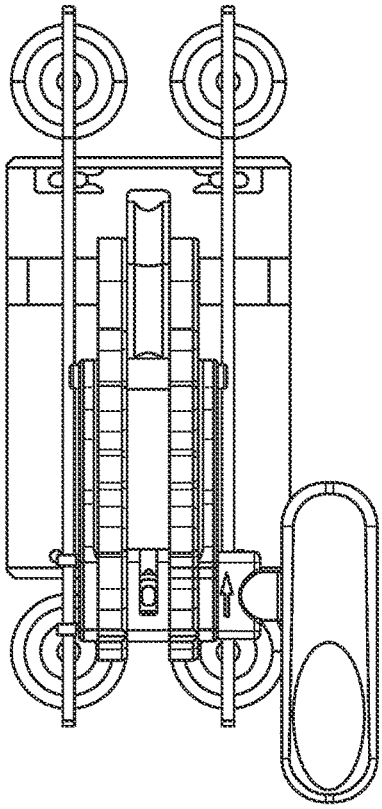
Figure 4A:
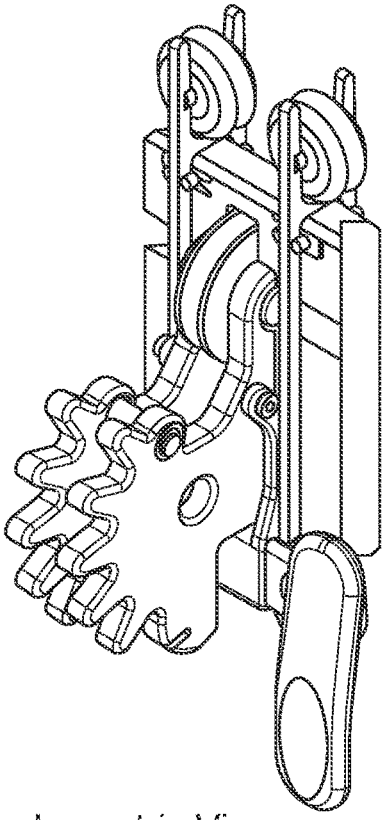
Figure 4A:
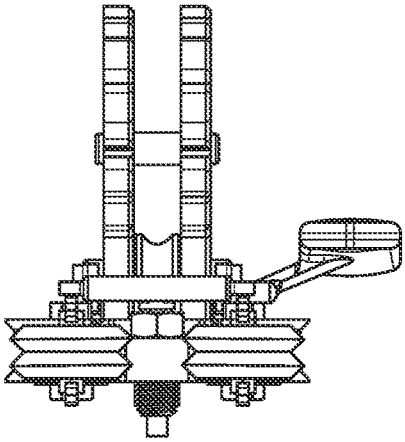
Figure 4B:
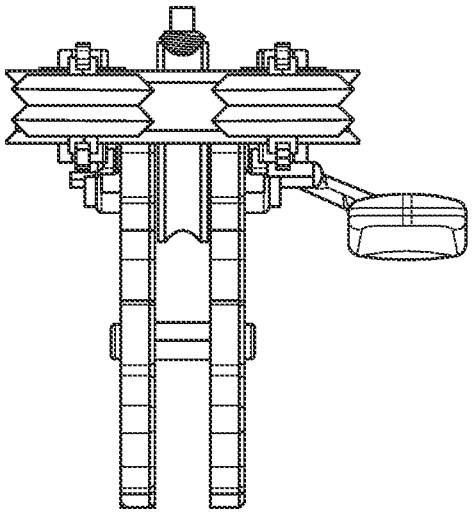
FIG. 4B illustrates several views for an embodiment of a carriage and column.
Figure 4B:
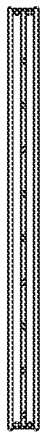
Figure 4B:
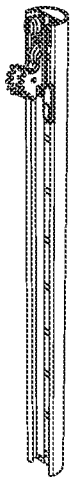
Figure 4B:
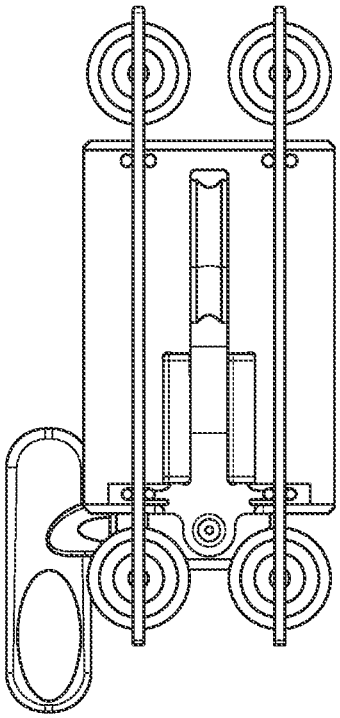
Figure 4B:
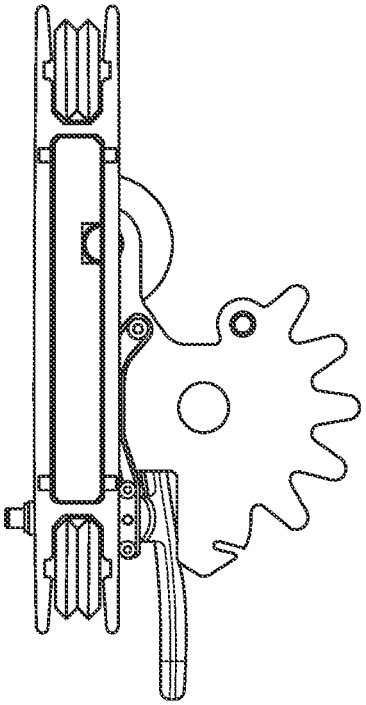

FIG. 4A illustrates several views for an embodiment of a carriage. A front view, right view, and bottom view of the carriage is illustrated, along with an isometric perspective. FIG. 4B illustrates several views for an embodiment of a carriage and column. A back view, left view, and top view of the carriage is illustrated, along with the column upon which the carriage slides in. An illustration is shown both of the column empty of a carriage and the column with a seated carriage.

In summary, the disclosed permits easy translation of a load bearing carriage when lightly loaded and yet becomes immobile when more heavily loaded. It is especially useful for applications where a load bearing appliance may be adjusted with minimal effort prior to the application of a load yet assumes immobility when a load is applied.

Easily, efficiently, and safely repositioning the load arms of an appliance used for personal exercise may be an important operation. Combining the two goals of easy movement to a new position and immobility once at that predetermined position is achieved using a wheel assembly, spring loaded so as to align with a track and support an unloaded carriage, whose spring allows the wheels to deflect to a reduced engagement position when the carriage is loaded and transfer the resulting load to the direct interface between the carriage and the track. A locking pin allows the carriage to remain in its preselected position when lightly loaded but when more heavily loaded, carriage friction with the track prevents movement along the track.

Column Lock. A rotatable column for an exercise machine is disclosed that supports one or more arms extending from the column with a cable that forms part of a pulley system to perform pulley-based exercises. Each arm may be between 2 and 5 feet long, for example 3 feet long, made of rigid material, for example steel, and may weigh up to 25 lbs, for example 10 lbs.

In one embodiment, the rotatable column provides the arm with a range of positions to allow a user to perform various exercises. The rotatable column may be attached to a scaffolding-like structure that retains the resistance mechanism utilized by the pulley system. The rotatable column may move into a discrete number of positions through a locking mechanism. The locking mechanism may include a solenoid coupled to a locking bar by way of a six bar linkage that engages and disengages a locking collar on the distal end of the rotatable column.

The solenoid may be utilized to synchronize the engagement and disengagement of the locking mechanism on opposing ends of the same rotatable column as well as other rotatable columns in the exercise machine. Note that in other embodiments, any mechanism may be used as an alternate to the solenoid, including but not limited to cables, springs, motors, hydraulics, pneumatics, or similar.

Figure 5:
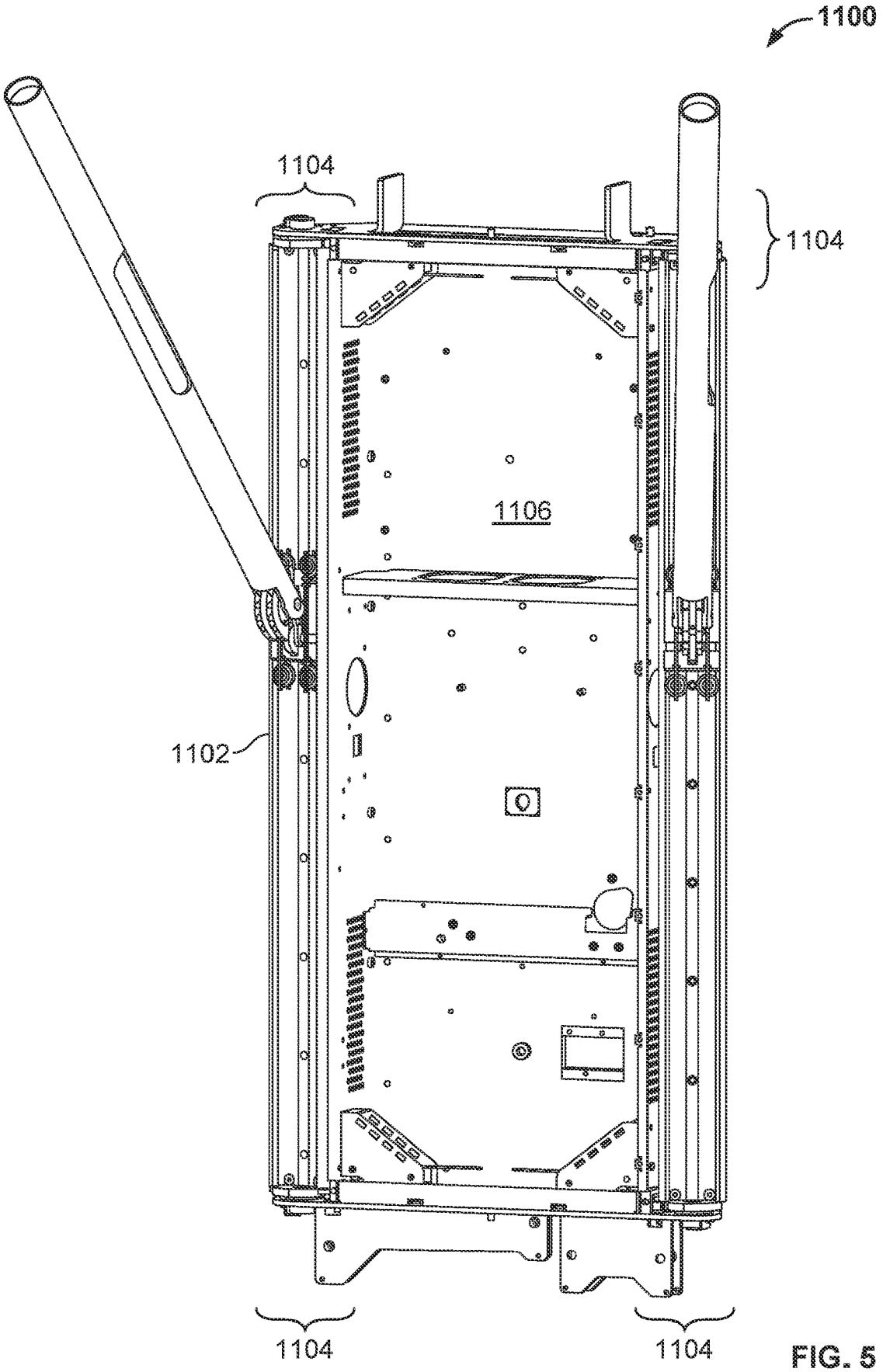
FIG. 5 illustrates a perspective view of an embodiment of an exercise machine.

FIG. 5 illustrates a perspective view of an embodiment of an exercise machine. The exercise machine (1100) includes four locking mechanisms (1104) coupled to two of columns (1102), joined by a scaffold (1106).

Figure 6:
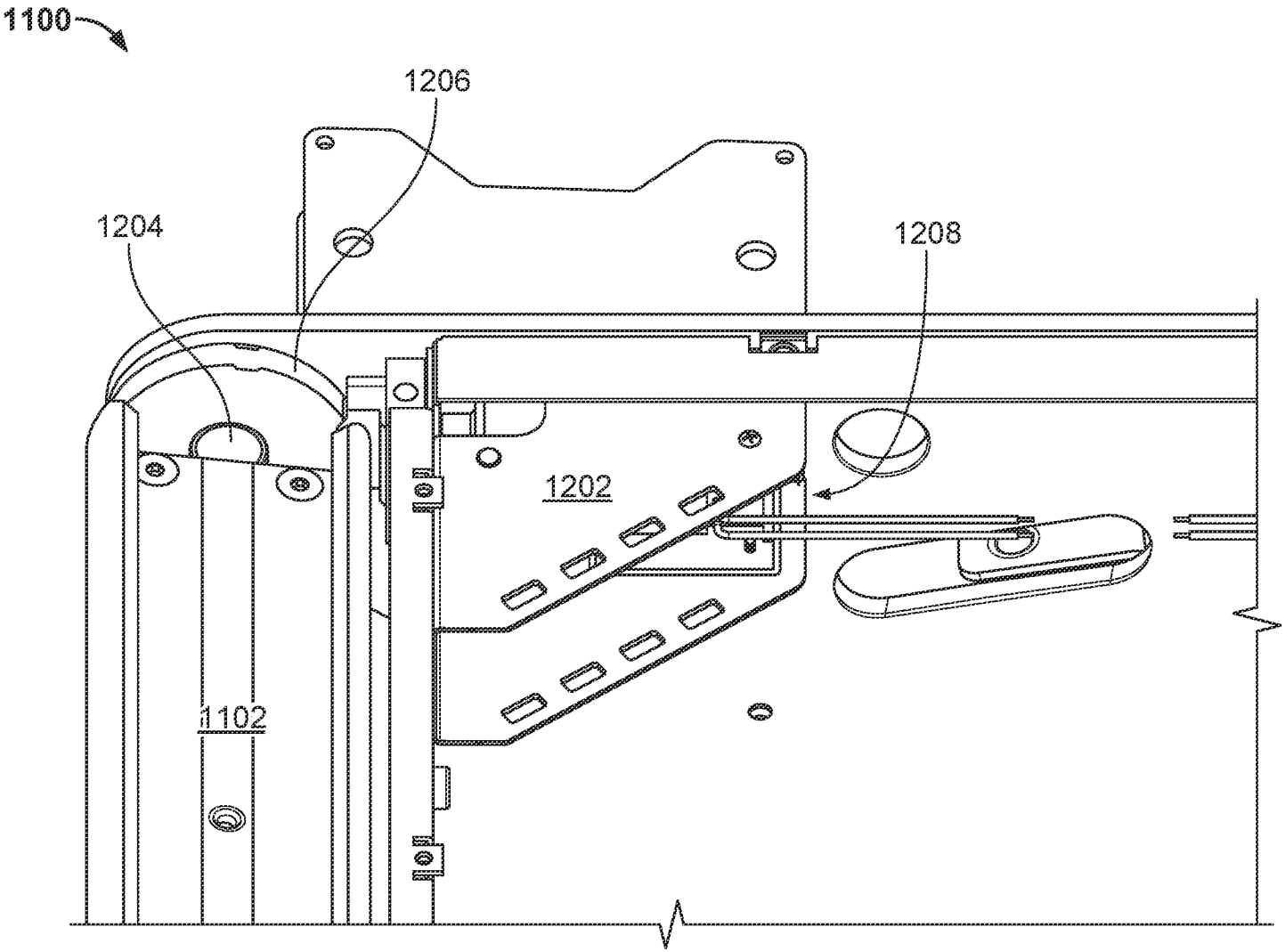
FIG. 6 illustrates an enhanced view of an embodiment of a locking mechanism.

FIG. 6 illustrates an enhanced view of an embodiment of a locking mechanism. In one embodiment, the locking mechanism shown in FIG. 6 is that locking mechanism (1104) in FIG. 5. In one embodiment, the locking mechanisms (1104) includes an axle (1204), a locking collar (1206), and a mounting bracket (1202). The bracket (1202) may also include a mount point (1208).

Figure 7:
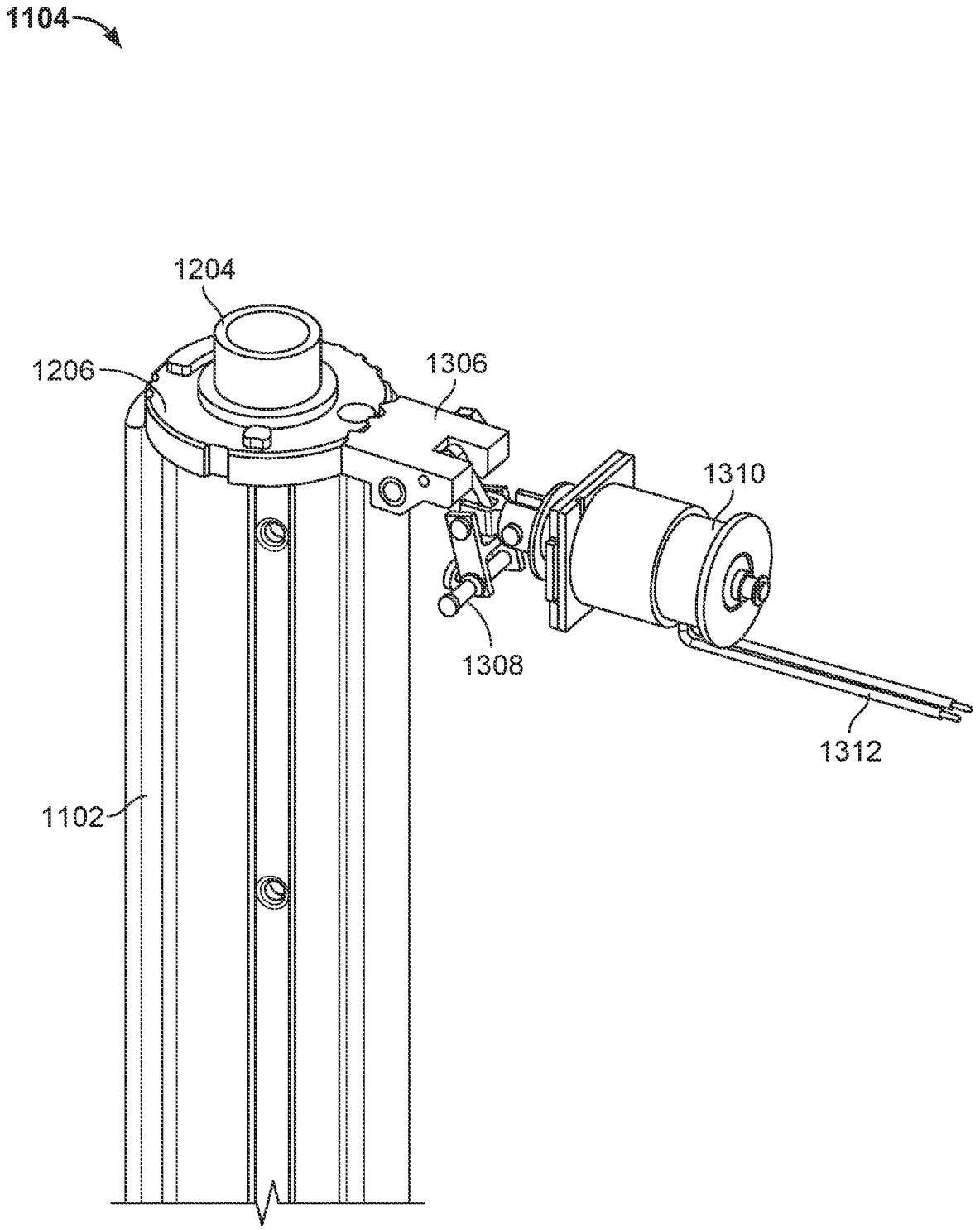
FIG. 7 illustrates a perspective view of an embodiment of a locking mechanism with a solenoid.

FIG. 7 illustrates a perspective view of an embodiment of a locking mechanism with a solenoid. In one embodiment, the locking mechanism (1104) includes an axle (1204), a locking collar (1206), a locking bar (1306), a linkage bar (1308), a solenoid (1310), and a set of electrical leads (1312) that power the solenoid (1310) following electrical actuation, for example via a wireless signal.

The locking collar (1206) may be coupled to the column (1102) at a distal end and limits travel of the column (1102) between the fixed positions when disengaged from a locking bar (1306). The axle (1204) may rotatably couple the center of the locking collar (1206) to the scaffold (1106) providing an axis of rotation for the locking collar (1206).

Figure 8:
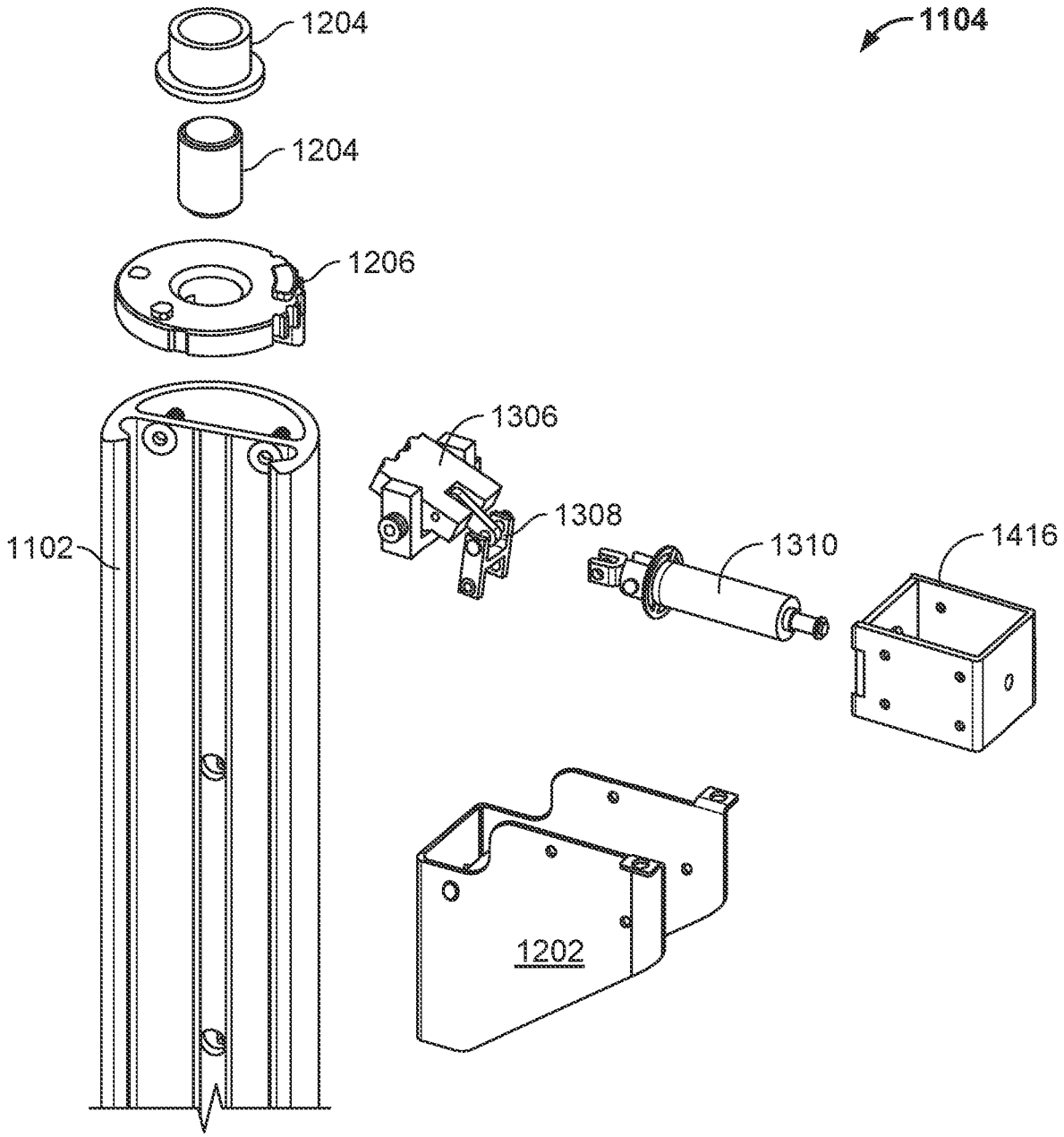
FIG. 8 illustrates an exploded view of an embodiment of a locking mechanism with a solenoid.

FIG. 8 illustrates an exploded view of an embodiment of a locking mechanism with a solenoid. In one embodiment, the locking mechanism (1104) includes an axle (1204), a locking collar (1206), a locking bar (1306), a linkage bar (1308), a solenoid (1310), a solenoid housing (1416), and a mounting bracket (1202). The locking collar (1206) may be coupled to the column (1102) at a distal end and limits travel of the column (1102) between the fixed positions when disengaged from a locking bar (1306). The axle (1204) may rotatably couple the center of the locking collar (1206) to the scaffold (1106) providing an axis of rotation for the locking collar (1206).

Figure 9:
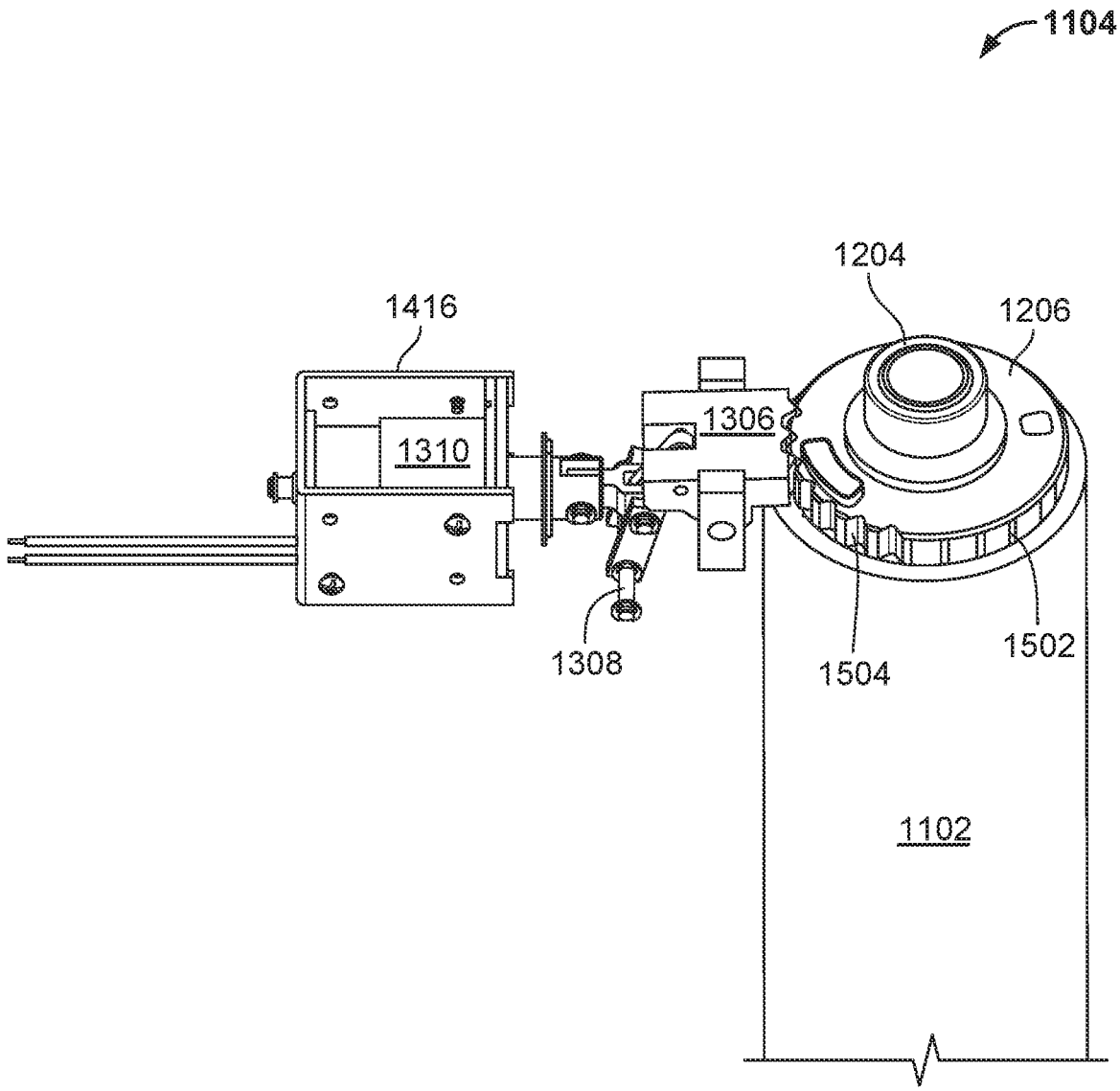
FIG. 9 illustrates a perspective view of an embodiment of a locking teeth mechanism.

FIG. 9 illustrates a perspective view of an embodiment of a locking teeth mechanism. In one embodiment, the locking mechanism includes an axle (1204), a locking collar (1206), a locking bar (1306), a linkage bar (1308), a solenoid (1310), and a solenoid housing (1416). The axle (1204) may rotatably couple the center of the locking collar (1206) to the scaffold (1106) providing an axis of rotation for the locking collar (1206). The locking collar (1206) may include detents (1502) and locking teeth (1504). The locking teeth (1504) may engage the locking bar (1306) in a tooth engagement, for example a three tooth engagement. Each of the locking positions may be provided by an incremental change between the locking teeth (1504) and the locking bar (1306) when the column (1102) is rotated.

Figure 10:
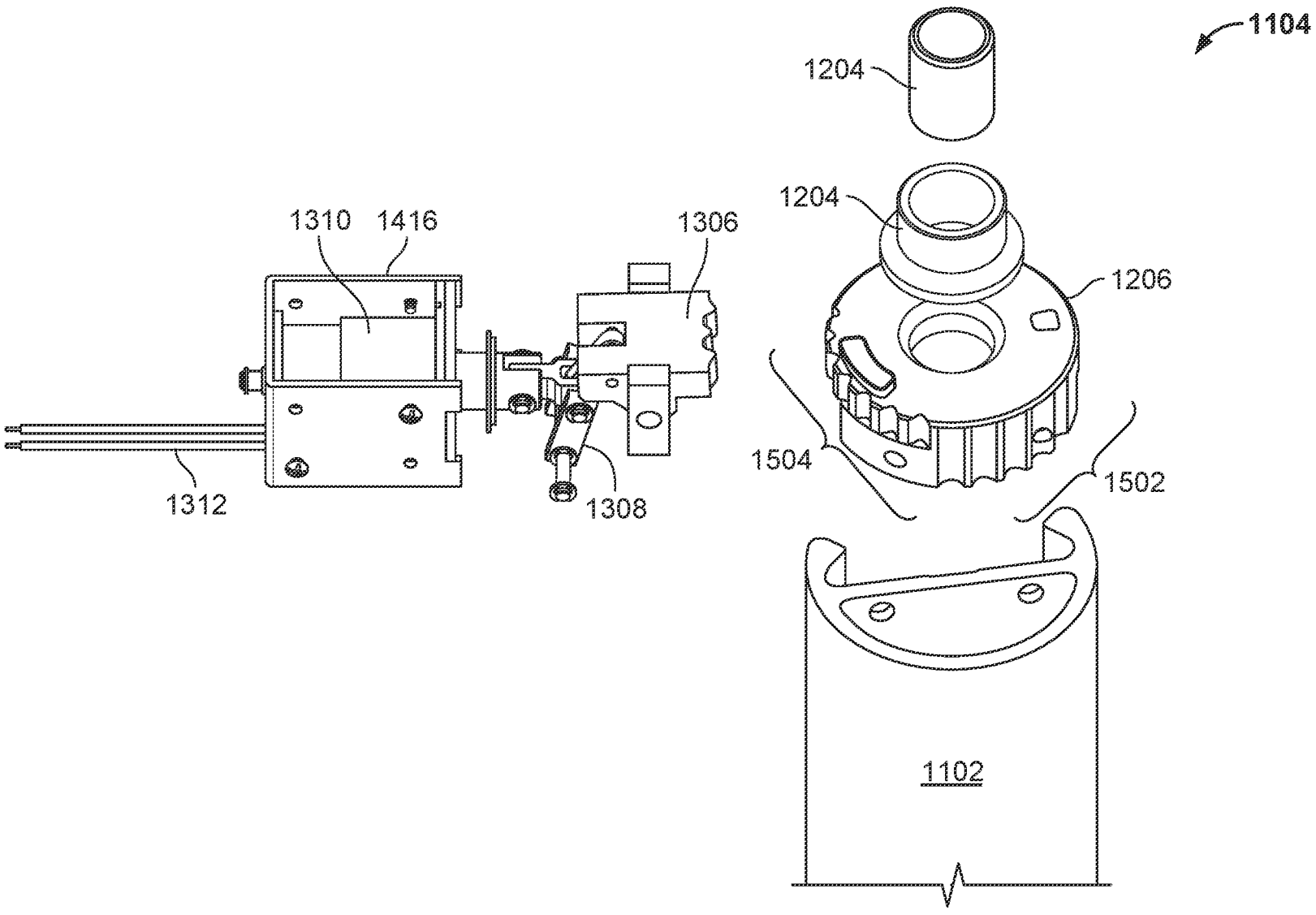
FIG. 10 illustrates an exploded view of an embodiment of a locking teeth mechanism.

FIG. 10 illustrates an exploded view of an embodiment of a locking teeth mechanism. As described in FIG. 9, the locking mechanism (1104) includes an axle (1204), a locking collar (1206), a locking bar (1306), a linkage bar (1308), a solenoid (1310), a solenoid housing (1416), and a set of electrical leads (1312) that power the solenoid (1310) following electrical actuation, for example via a wireless signal.

The locking collar (1206) may be coupled to the column (1102) at a distal end and limits travel of the column (1102) between the fixed positions when disengaged from a locking bar (1306). The axle (1204) may rotatably couple the center of the locking collar (1206) to the scaffold (1106) providing an axis of rotation for the locking collar (1206). The locking collar (1206) may include detents (1502) and locking teeth (1504). The locking teeth (1504) may engage the locking bar (1306) in a tooth engagement, for example a three tooth engagement. Each of the locking positions may be provided by an incremental change between the locking teeth (1504) and the locking bar (1306) when the column (1102) is rotated.

Figure 11:
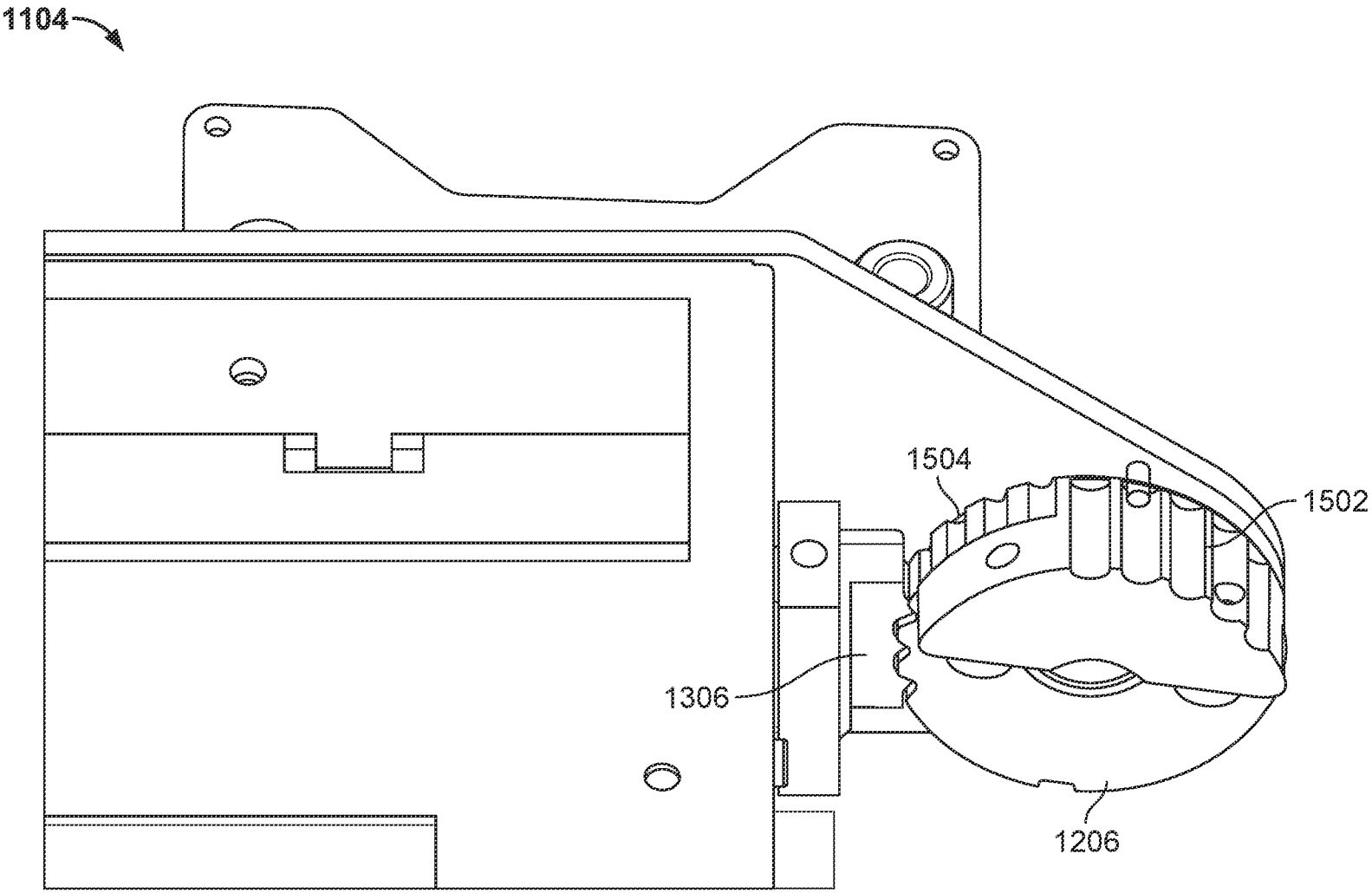
FIG. 11 illustrates a bottom perspective view of an embodiment of locking teeth mounted in an exercise machine.

FIG. 11 illustrates a bottom perspective view of an embodiment of locking teeth mounted in an exercise machine. Locking collar (1206) includes detents (1502) and locking teeth (1504) to be engaged and disengaged from a locking bar (1306).

Figure 12:
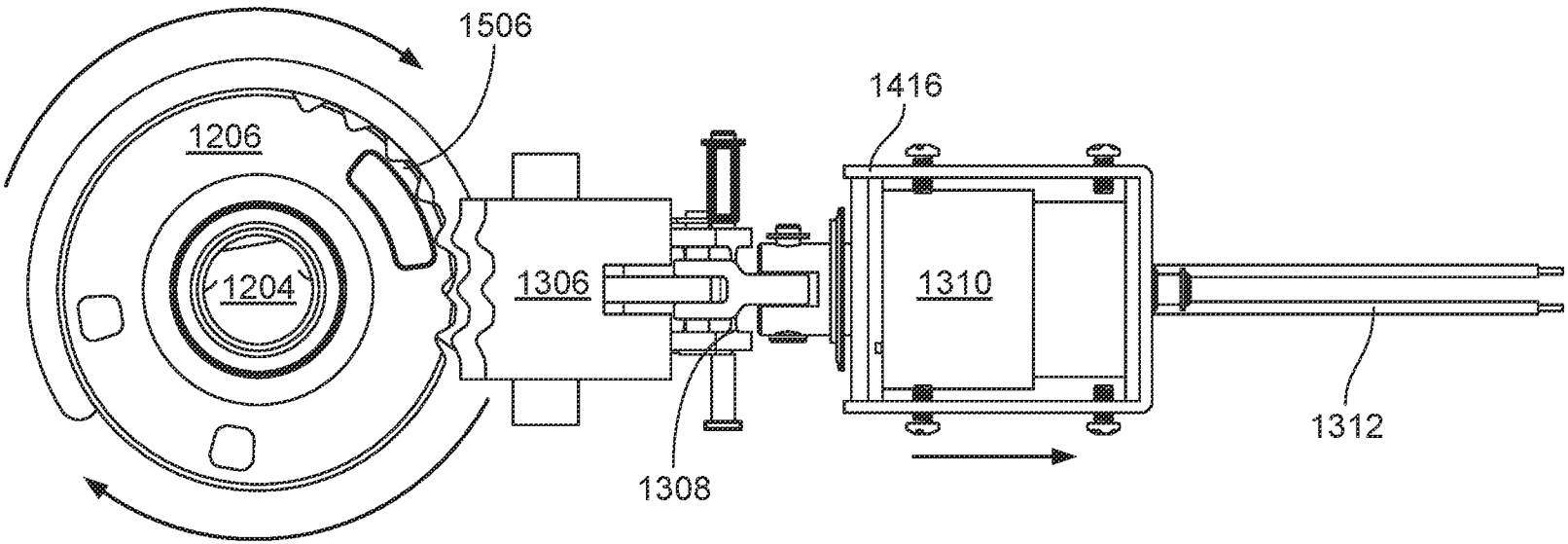
FIG. 12 illustrates a top view of an embodiment of a locking teeth mechanism.

FIG. 12 illustrates a top view of an embodiment of a locking teeth mechanism. A column (1102) may provide a mounting point for other exercise equipment such as bars utilized for arm presses. Each column (1102) may be rotatably coupled to two of the locking teeth (1504) positioned at opposite ends of the column (1102). The locking mechanisms (1104) may allow the columns to rotate into different positions, allowing a user to adjust the exercise equipment to their body and/or to allow them to perform different exercises. The locking mechanisms (1104) may fix the position of the column securely and prevent unwanted movement due to external forces. The locking mechanisms (1104) may lock the column (1102) in one of a plurality of different rotational positions, in one embodiment, five such positions.

In one embodiment, the locking mechanism (1104) includes an axle (1204), a locking collar (1206), a locking bar (1306), a linkage bar (1308), a solenoid (1310), a solenoid housing (1416), and a mounting bracket (1202). The locking collar (1206) may be coupled to the column (1102) at a distal end and limits travel of the column (1102) between the fixed positions when disengaged from a locking bar (1306). The axle (1204) may rotatably couple the center of the locking collar (1206) to the scaffold (1106) providing an axis of rotation for the locking collar (1206). The locking collar (1206) may include detents (1502) and locking teeth (1504). The locking teeth (1504) may engage the locking bar (1306) in a tooth engagement, for example a three tooth engagement. Each of the locking positions may be provided by an incremental change between the locking teeth (1504) and the locking bar (1306) when the column (1102) is rotated.

In addition to locking teeth (1504), the locking collar (1206) may include a set of detents (1502) that provide haptic feedback to a user as the column (1102) rotates between the different positions. In one embodiment, the locking teeth (1504) includes five locking positions radially spaced 25° from each other. In one embodiment, the locking teeth (1504) may include an additional storage position, and the detents (1502) may also provide feedback to the user that the column (1102) has been rotated into a stored configuration.

In one embodiment, the free rotation of the column (1102) is determined by the engagement or disengagement of the locking collar (1206) with the locking bar (1306). The locking bar (1306) may be rotated by the actuation of a solenoid (1310) coupled to a linkage bar (1308). The linkage bar (1308) may form a six bar linkage with the locking bar (1306) and the solenoid (1310). The solenoid (1310) may be positioned within solenoid housing (1416) and is coupled to a set of electrical leads (1312) that power the solenoid (1310) following electrical actuation, for example via a wireless signal.

The locking mechanism (1104) may be in an over-center configuration or an under-center configuration.

Figure 13:
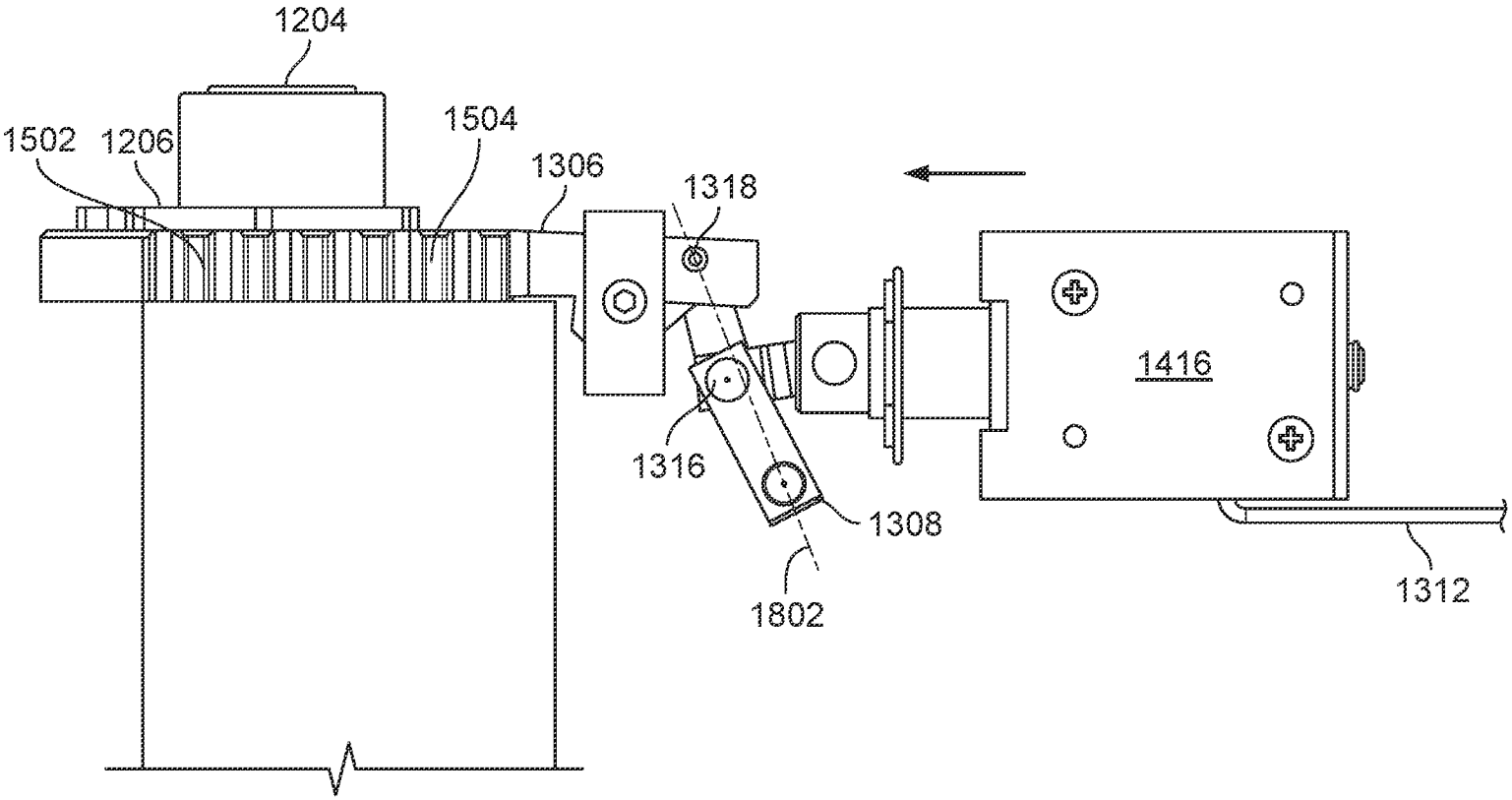
FIG. 13 illustrates a lateral view of an embodiment of a locking mechanism in an over-center configuration.

FIG. 13 illustrates a lateral view of an embodiment of a locking mechanism in an over-center configuration. A center-line (1802) is drawn through locking bar linkage pin (1318) and linkage bar (1308). "Over-center" means that pivot pin (1316) is to the left of center-line (1802), as shown in FIG. 13.

In FIG. 13, solenoid (1416) has been activated, pushing pivot pin (1316) "over-center", causing locking bar (1306) to engage with locking teeth (1504). In this locked position, no movement of locking bar (1306) can cause pivot pin (1316) to move to the right of center-line (1802) and thereby disengage the lock. Since locking bar (1306) is the only component among pivot pin (1316), linkage bar (1308) and solenoid (1416) that can be jostled, even slightly, during a user's exercise, there is no way for the column lock to disengage accidently. Only when the user explicitly activates solenoid (1416) does pivot pin (1316) retract, enabling column (1102) to rotate.

Figure 14:
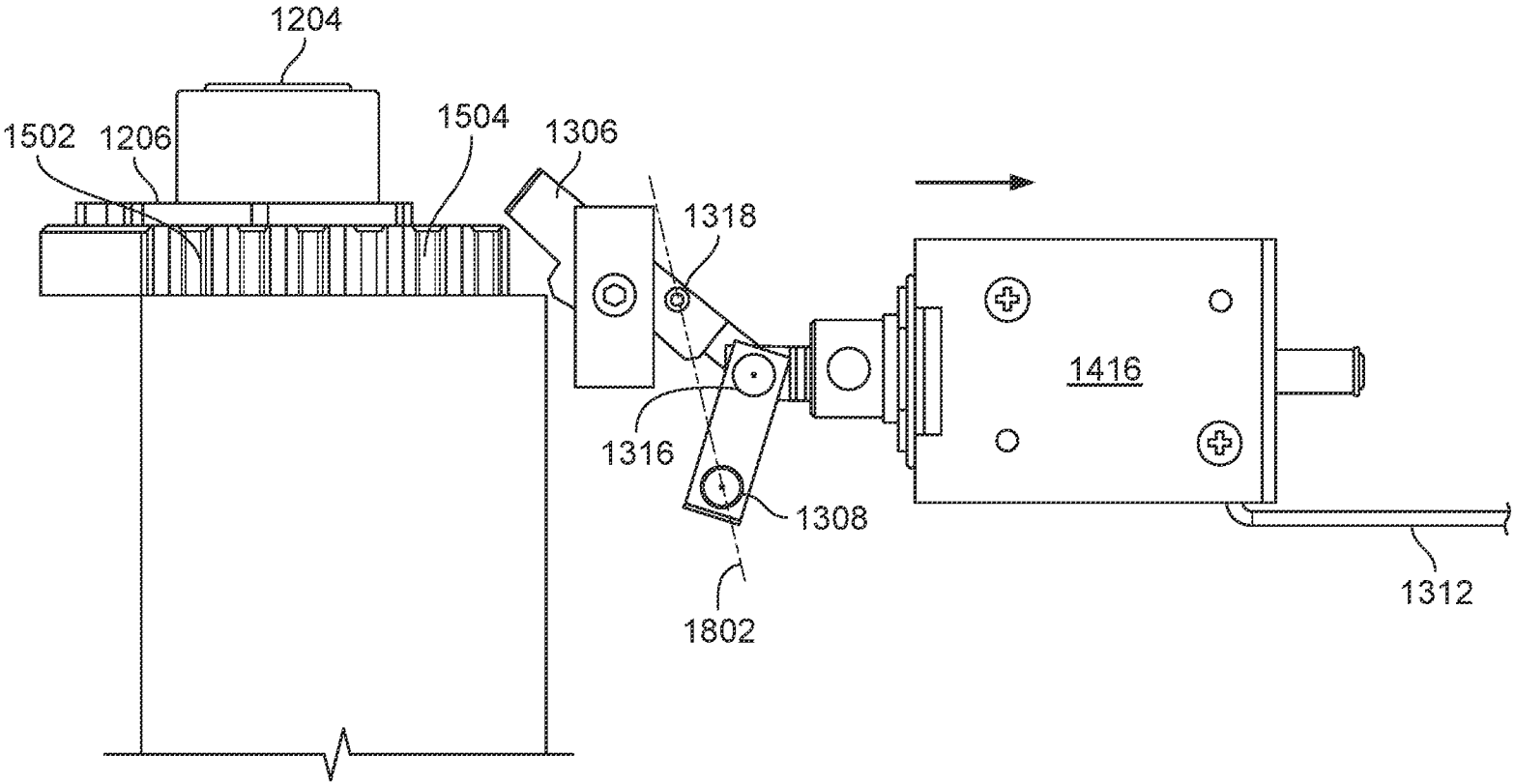
FIG. 14 illustrates a lateral view of an embodiment of a locking mechanism in an under-center configuration.

FIG. 14 illustrates a lateral view of an embodiment of a locking mechanism in an under-center configuration. Under center is the opposite of over-center: pivot pin (1316) is now to the right of center-line (1802). FIG. 14 shows the disengaged position. Here, solenoid (1416) has retracted, causing pivot pin (1316) to move to the right of center-line (1802), which, in turn, causes locking bar (1306) to disengage from locking teeth (1504).

In one embodiment, the locking bar (1306), the linkage bar (1308), and the solenoid housing (1416) including the solenoid (1310) are mounted to the scaffold (1106) through a mounting bracket (1202). The mounting bracket (1202) may align the locking bar (1306), the linkage bar (1308), and the solenoid (1310) to interact with the locking collar (1206).

In one embodiment, the mounting bracket (1202) is a bracket that holds the locking bar (1306), linkage bar (1308), solenoid (1310), and solenoid housing (1416) and allows the mounting of these components to a scaffold (1106) of a larger machine that includes the column (1102), as shown in FIG. 1 with four locking mechanisms (1104) on four corners, two per column.

In one embodiment, the solenoid (1310) is mounted within the solenoid housing (1416) which mounts to the mounting bracket (1202). The solenoid (1310) may be actuated electronically, through a remote control or via wires with a printed circuit board [PCB] wired or wirelessly coupled to the solenoid (1310) through the electrical leads (1312), or via a transceiver. When the solenoid (1310) is actuated, the solenoid (1310) body may pull away from the direction of the column (1102).

The movement of the solenoid (1310) may pull the linkage bar (1308), transforming the lateral motion into a rotational motion of the linkage bar (1308) about its pivotable coupling between the linkage bar (1308) and the solenoid (1310) and the linkage bar (1308) and the mounting bracket (1202). The rotational motion of the linkage bar (1308) may then be transferred to the locking bar (1306) through the pivotable coupling of the linkage bar (1308) and the locking bar (1306) through the pivot point on the mounting bracket (1202). The rotational motion of the locking bar (1306) may disengage the locking bar (1306) from the locking teeth (1504) allowing the locking collar (1206)/column (1102) to rotate about the axle (1204) between the locking positions.

In one embodiment, the solenoid (1310) uses mechanical-mechanical actuation. While mechanical actuation is possible, electronic actuation may be favored due to the two-column configuration of the exercise machine (1100). With a two-column configuration, a mechanical-mechanical actuation may require that each column is actuated individually to rotate/unlock the column. Electrical actuation may allow the simultaneous actuation of both columns, facilitating the reconfiguration for the user.

In one embodiment, the materials from which the components of locking mechanism (1104) can be made comprise any rigid materials including, without limitation, steel, aluminum, high strength plastic, and carbon fiber. Moreover, these components can be manufactured using any manufacturing method, including, without limitation, injection molding, casting, machining, forging, and 3D printing.

In one embodiment, the disclosed exercise machine includes a rotatable column that supports an arm extending from the column with a cable that form part of a pulley system to perform pulley based exercises. The rotatable column may provide the arm with a range of positions to allow a user to perform various exercises. The rotatable column may then be attached to a scaffolding-like structure that holds the resistance mechanism utilized by the pulley system.

The rotatable column may move into a discrete number of positions through a locking mechanism. The locking mechanism may include a solenoid coupled to a locking bar by way of a six-bar linkage that engages and disengages a locking collar on the distal end of the rotatable column. The solenoid may be utilized to synchronize the engagement and disengagement of the locking mechanism on opposing ends of the same rotatable column as well as other rotatable columns in the exercise machine.

Arm Lock. An exercise machine comprising a tiltable arm and a locking gear mechanism on a column carriage to support a discrete number of positions for the tiltable arm is disclosed. In one embodiment, the tiltable arm and the locking gear mechanism have a cable threaded through them forming part of a pulley system to perform pulley based exercises. The tiltable arm rotates around a horizontal axis with fixed stopping points serving as locking positions for the arm. The locking gear mechanism includes various teeth machined to permit the arm to slide into a fixed position from a storage position without actuating a locking member.

Figure 15:
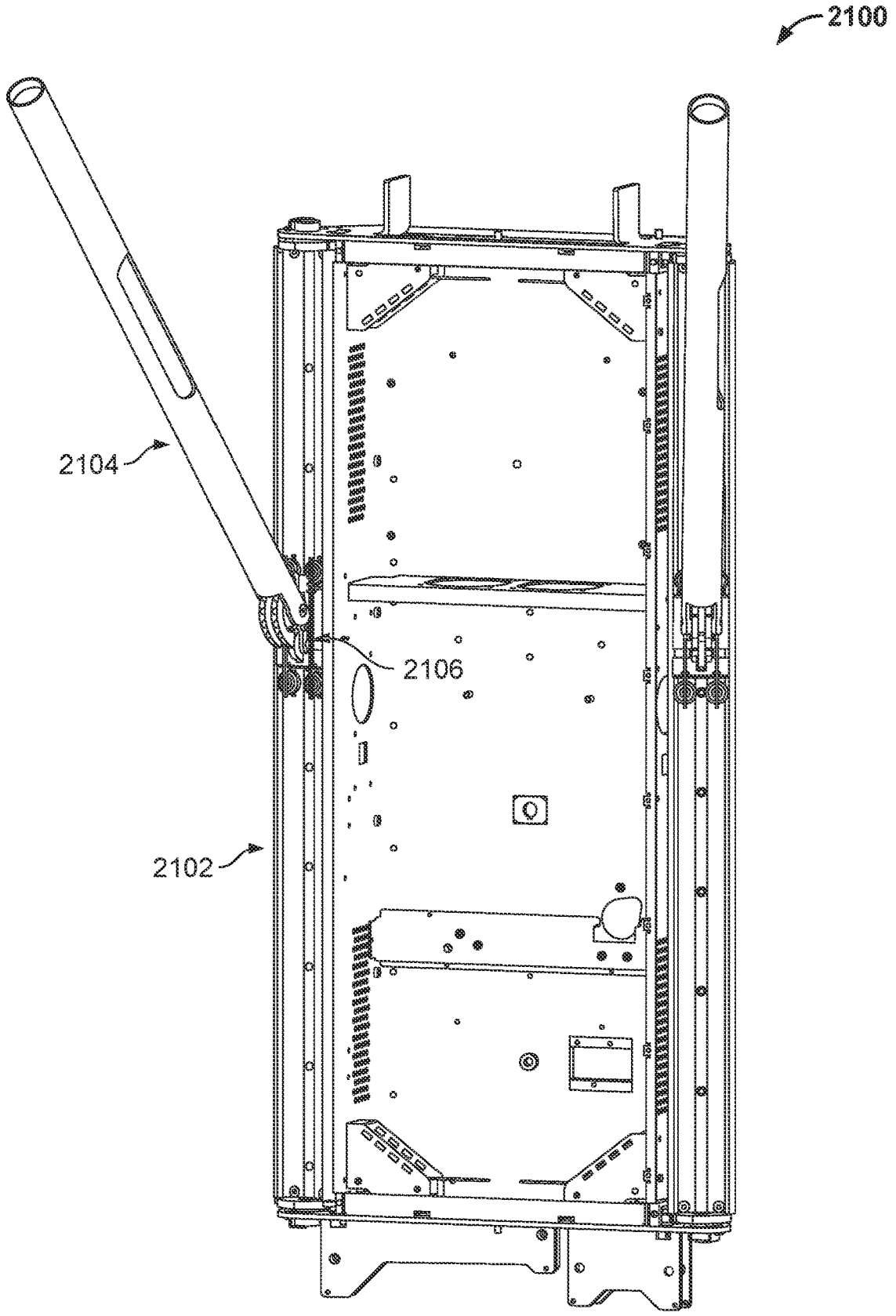
FIG. 15 illustrates an embodiment of an exercise machine.

FIG. 15 illustrates an embodiment of an exercise machine. An exercise machine may include a column carriage (2106), a column (2102), and an arm (2104). The arm (2104) may be between 2 and 5 feet long, for example 3 feet long, made of rigid material, for example steel, and may weigh up to 25 lbs, for example 10 lbs.

Figure 16:
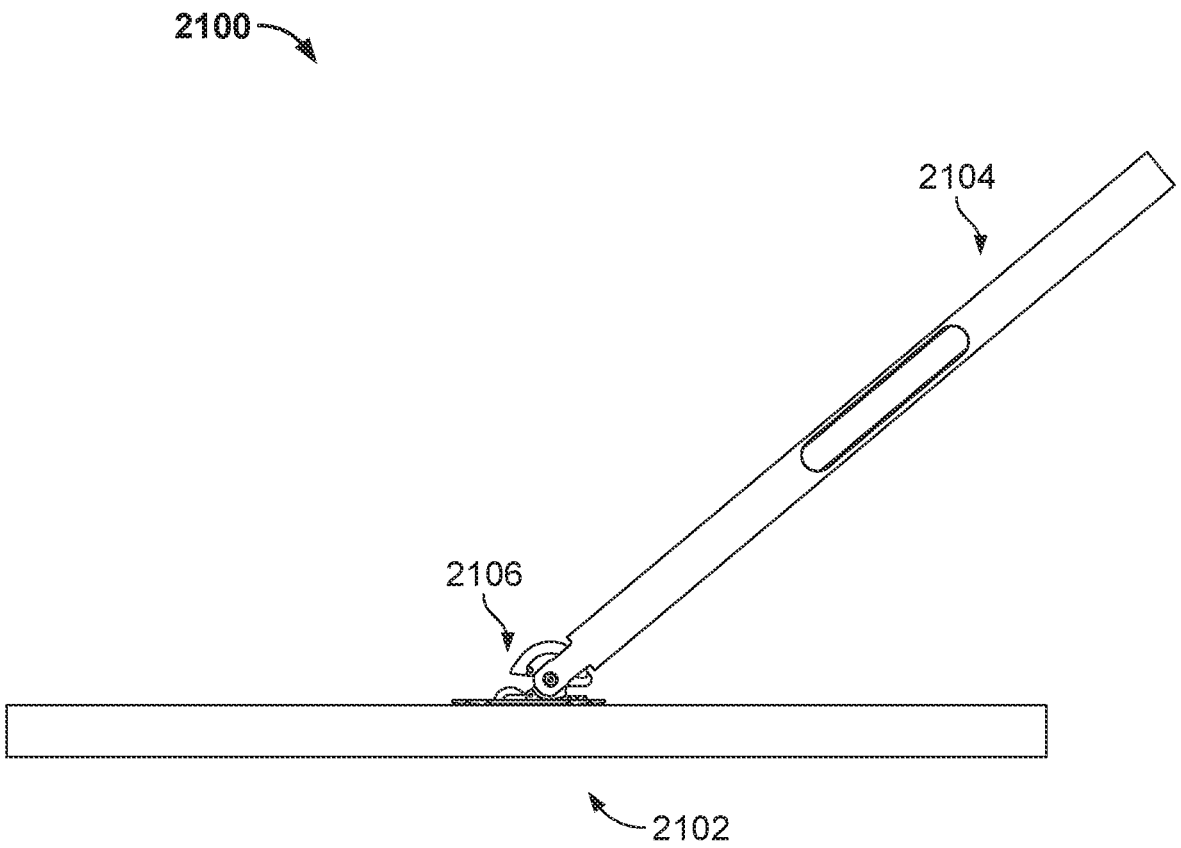
FIG. 16 illustrates a lateral view of an embodiment of an exercise machine component.

FIG. 16 illustrates a lateral view of an embodiment of an exercise machine component. In one embodiment, the arm (2104) and the column carriage (2106) are rotatably coupled to each other through a locking mechanism.

Figure 17:
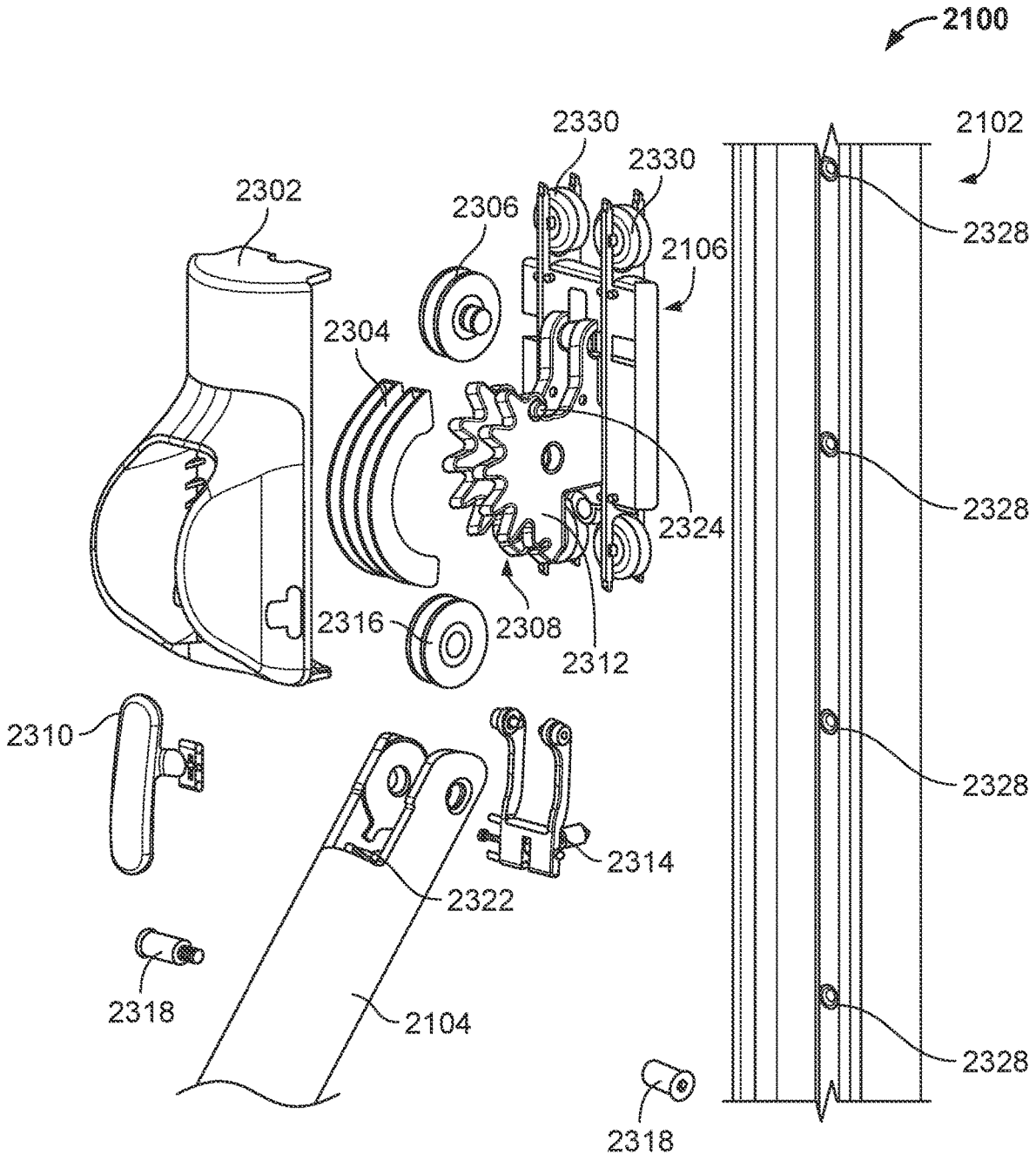
FIG. 17 illustrates an exploded view of an embodiment of an exercise machine component.

FIG. 17 illustrates an exploded view of an embodiment of an exercise machine component. In one embodiment, the arm (2104) and the column carriage (2106) are rotatably coupled to each other through a locking mechanism. that comprises a sagittal gear (2308) on the column carriage (2106) and a locking member (2322) within the arm (2104). The column carriage (2106) may be moveably coupled to the column (2102) through the engagements of the rollers (2330) and a column groove. The column (2102) may include a plurality of notches (2328) that are engageable through the column stop (2314) of the column carriage (2106) forming fixed locking points along the length of the column.

In one embodiment, the arm (2104), the column carriage (2106), and the column (2102) are traversed by a cable which serves as part of a pulley system allowing a user to perform pulley based exercises. Rotation of the arm (2104) about the column carriage (2106) may allow the user to adjust the arm (2104) to perform certain exercises.

In one embodiment, the rotatable movement of the arm (2104) relative to the column carriage (2106) occurs about an axle pin (2318). The axle pin (2318) couples the arm (2104) to the column carriage (2106). To accommodate the movement and passage of the pulley cable through the arm (2104), the sagittal gear (2308) is bisected allowing placement of an arm wheel (2316) that is secured in place with the axle pin (2318). The arm wheel (2316) and a cable pulley/guide (2306) function as wheels for the pulley system through which a cable is threaded. The arm wheel (2316) guides a cable from the cable pulley/guide (2306) and up through the center of the arm (2104).

In one embodiment, a stopper (2324) creates a hard stop engagement with the sagittal gear (2308) preventing rotation of the arm (2104) past the upmost vertical position of the sagittal gear (2308).

In one embodiment, when the locking member (2322) is engaged to the teeth (2312) of the sagittal gear (2308), the sagittal gear (2308) bears the weight from the arm (2104) and the downward force from the pulley cables.

In one embodiment, a gear shroud (2304) is positioned over the sagittal gear (2308). The gear shroud (2304) covers the sagittal gear (2308) and provides protection to fingers from the sagittal gear (2308). The arm assembly cover (2302) may be provided to cover the coupling between the column carriage (2106) and the arm (2104). A column stop (2314) may include a pin that goes through the notches (2328) in the column (2102) locking the column carriage (2106) from moving along the length of the column (2102). A paddle (2310) may be coupled to the column stop (2314) and when actuated by a user transfers force to column stop (2314) to pull the pin out of the notches (2328) and thereby enable moving the column carriage (2106) to different positions along the length of the column (2102).

The arm (2104) may be rotatable to the column carriage (2106) about the engagement between the sagittal gear (2308) and the axle pin (2318). In one embodiment, the arm (2104) is able to rotate about the sagittal gear (2308) between the fixed positions formed by the engagement of the teeth (2312) with the locking member (2322). In one embodiment, the arm (2104) has five fixed positions comprising a perpendicular position to the column (2102) that resides centrally on the sagittal gear (2308), surrounded by two incremental angular positions on both sides.

In one embodiment, each angular position of the teeth (2312) corresponds to a 15° degree increment from the prior detent. During the transition between detent positions, the locking member (2322) may remain in contact with the teeth (2312). The contact pressure between the locking member (2322) and the teeth (2312) may provide a haptic feedback to the user allowing them to differentiate between locking positions when rotating the arm. As the arm (2104) continues to move, the locking member (2322) comes into alignment with the teeth (2312) and locks in to the first fixed position. The translation of the locking member (2322) on the profile of the detent (2312) on the sagittal gear (2308) provides a haptic feedback to the user when moving the arm (2104) to different positions.

In one embodiment, the engagement between the teeth (2312) and the locking member (2322) allows for the locking member (2322) to be withdrawn from a locked position relative sagittal gear (2308) while maintaining some contact with the teeth (2312). The spring-loaded contact of the locking member (2322) creates a 'positional bias' at a number of distinct positions around sagittal gear (2308).

In one embodiment, the sagittal gear (2308) includes an arm (2104) position for a storage configuration. In the storage configuration, the arm (2104) may be found positioned parallel or nearly parallel to the column (2102), reducing the profile of the exercise machine component (2100). In the storage configuration, the locking member (2322) is in contact with the sagittal gear (2308), but not open position. With the locking member (2322) in an open position when stored, the arm (2104) can be moved into a fixed locking position without actuation of the locking member (2322). As the arm (2104) is moved from the storage position, the locking member (2322) may contact the edge of the closest teeth (2312) providing a haptic feedback, and indicate that the locking member (2322) is about to engage the teeth (2312) in a fixed position.

The angle of the side of the teeth (2312) of sagittal gear (2308) compared against the perpendicular line arising from the surface of the sagittal gear (2308) can range from 0 degrees (i.e. perpendicular) to 45 degrees, and the tip of teeth (2312) can be squared or curved. The shape of each corresponding opening on the locking member (2322) matches the angle and shape of teeth (2312). This matched angle, also referenced as the angle of coincidence between the teeth (2312) and corresponding opening, may be designed to provide for a spring-driven-centering of the position of the arm (2104) when in locked position. When the angle is too low, no centering force may be generated and slop would result. When the angle is too high, operational forces enacted onto the arm (2104) may, because of sin theta resultant force, drive the tooth out and make the connection to be lost. In one embodiment, this angle is approximately degrees.

Figure 18:
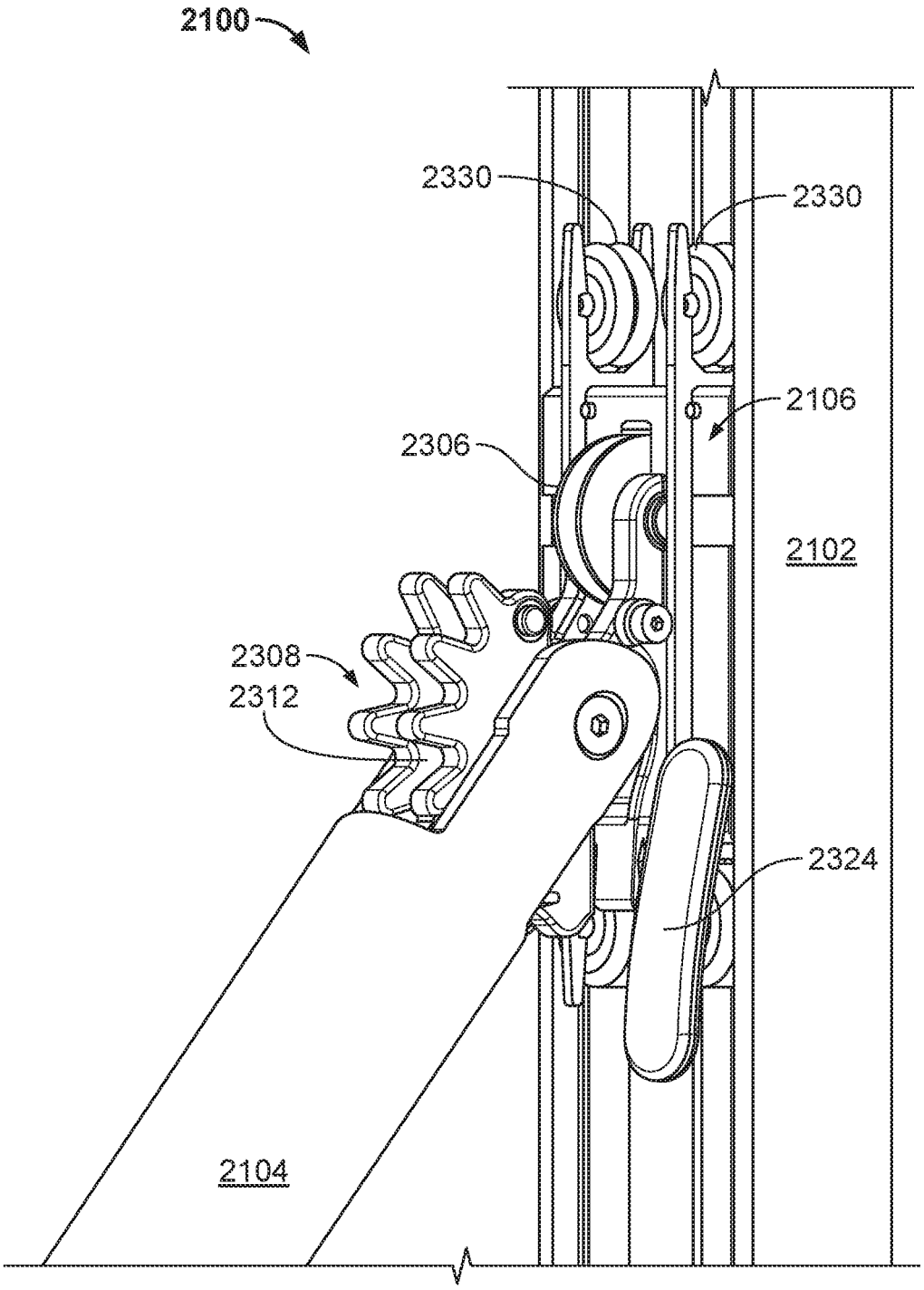
FIG. 18 illustrates a perspective view of an embodiment of an exercise machine component.

FIG. 18 illustrates a perspective view of an embodiment of an exercise machine component. In one embodiment, the arm (2104) and the column carriage (2106) are rotatably coupled to each other through a locking mechanism. that comprises a sagittal gear (2308) with teeth (2312) on the column carriage (2106) and a locking member within the arm (2104). The column carriage (2106) may be moveably coupled to the column (2102) through the engagements of the rollers (2330) and a column groove.

Figure 19:
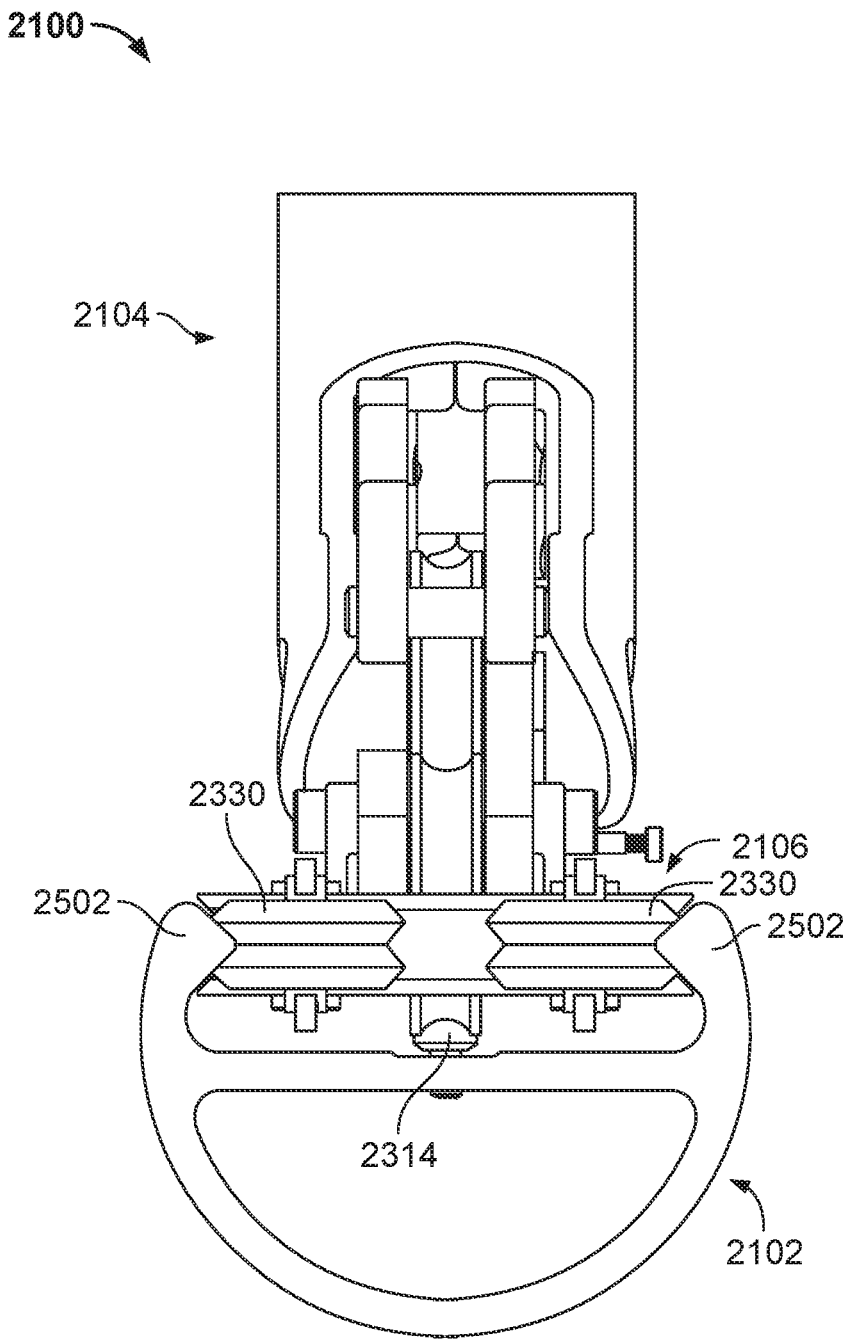
FIG. 19 illustrates a top view of an embodiment of an exercise machine component.

FIG. 19 illustrates a top view of an embodiment of an exercise machine component. In one embodiment, the arm (2104) and the column carriage (2106) are rotatably coupled to each other through a locking mechanism on the column carriage (2106). The column carriage (2106) may be moveably coupled to the column (2102) through the engagements of the rollers (2330) and the column groove (2502). The column (2102) may include a plurality of notches that are engageable through the column stop (2314) of the column carriage (2106) forming fixed locking points along the length of the column.

Figure 20:
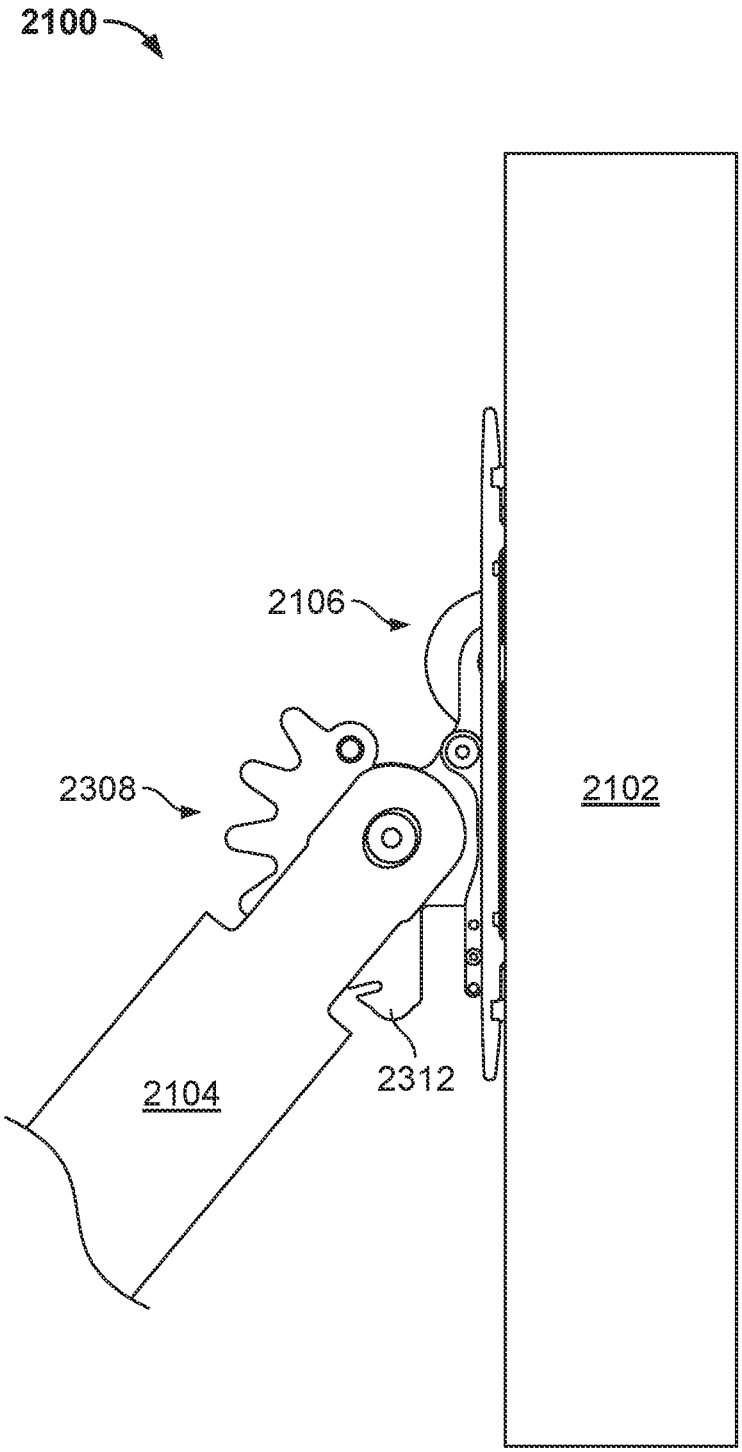
FIG. 20 illustrates a lateral view of an embodiment of an exercise machine component.

FIG. 20 illustrates a lateral view of an embodiment of an exercise machine component. In one embodiment, the arm (2104) and the column carriage (2106) are rotatably coupled to each other through a locking mechanism. that comprises a sagittal gear (2308) with teeth (2312) on the column carriage (2106) and a locking member within the arm (2104).

Figure 21:
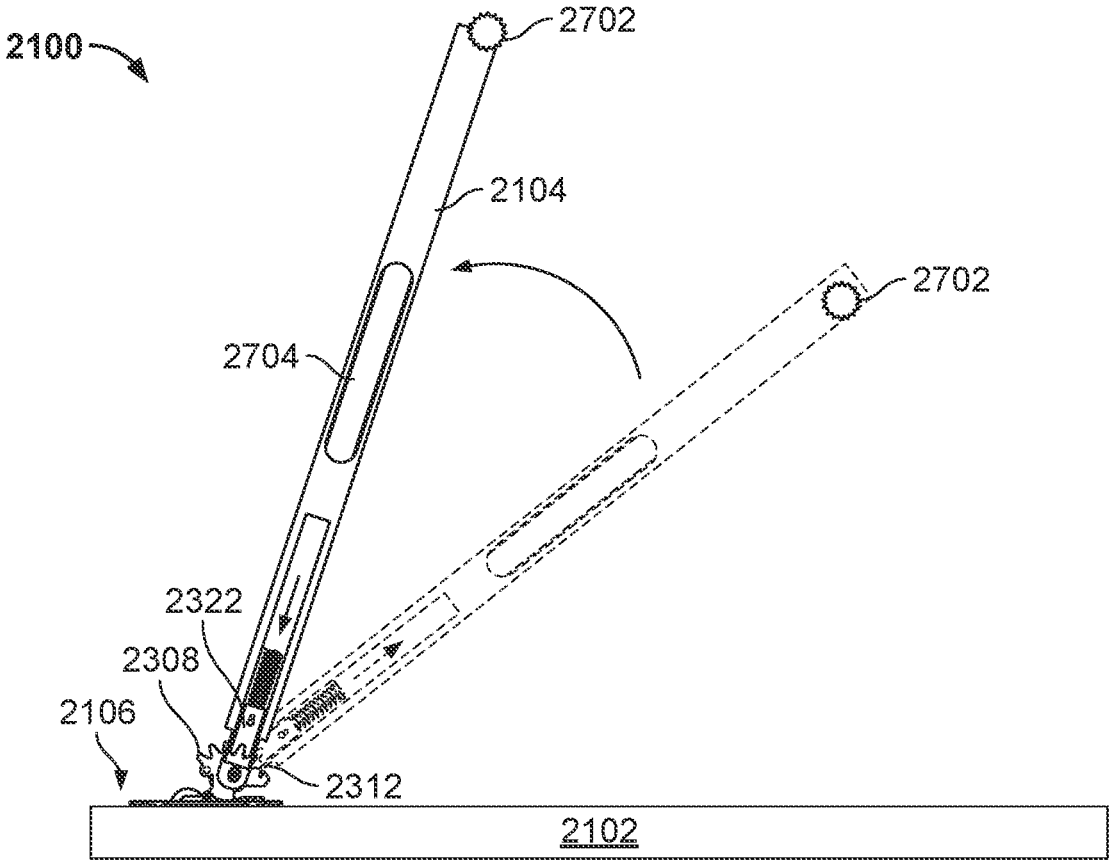
FIG. 21 illustrates a lateral view of an embodiment of an exercise machine component while the arm is changing positions.

FIG. 21 illustrates a lateral view of an embodiment of an exercise machine component while the arm is changing positions. In one embodiment, the arm (2104) includes an actuator (2702) which comprises a handle (2704). The handle (2704) may be positioned within the body of the arm (2104) and, when actuated, for example pulled or pushed, allows the locking member (2322) to disengage from teeth (2312) of the sagittal gear (2308) on column carriage (2106). The handle (2704) may be operatively coupled to the locking member (2322) through a cable or wire allowing the locking member (2322) to disengage from the teeth (2312). The disengagement of the locking member (2322) from the teeth (2312) allows the arm (2104) to change positions and accommodate a user to perform other exercises. The teeth (2312) of the sagittal gear (2308) may include one horizontal position and two stops above and below horizontal making five positions in total. In addition to the five fixed positions, the sagittal gear (2308) may include a storage position for the arm (2104), where the bottom stop tip allows the arm (2104) to be parallel or almost parallel to the column (2102). Outside of the five positions, the arm (2104) may be straight down flush to the column (2102) and may provide some haptic feedback as the arm (2104) is rotated toward the lowest teeth (2312) from the storage position.

In one embodiment, the teeth of the sagittal gear (2308) are split into two such that a pulley can be inserted into the middle allowing a path for an exercise cable to route. Furthermore, locking member (2322) has split teeth engagement features such that they can engage a split tooth without interfering with gear shroud (2304).

In one embodiment, the profile of the teeth (2312) on the sagittal gear (2308) provides a haptic feedback to the user when moving the arm (2104) to different positions. The engagement between the teeth (2312) and the locking member (2322) may allow for the locking member (2322) to be withdrawn from a locking position while maintaining some contact with the teeth (2312). When the arm (2104) is being moved between different locking positions, the shape of the teeth (2312) may allow the locking member (2322) to glide over the teeth (2312) allowing the user a haptic sensation differentiating individual teeth (2312). In an alternate embodiment, the locking member (2322) may be fully withdrawn so that it makes no contact with teeth (2312).

Figure 22:
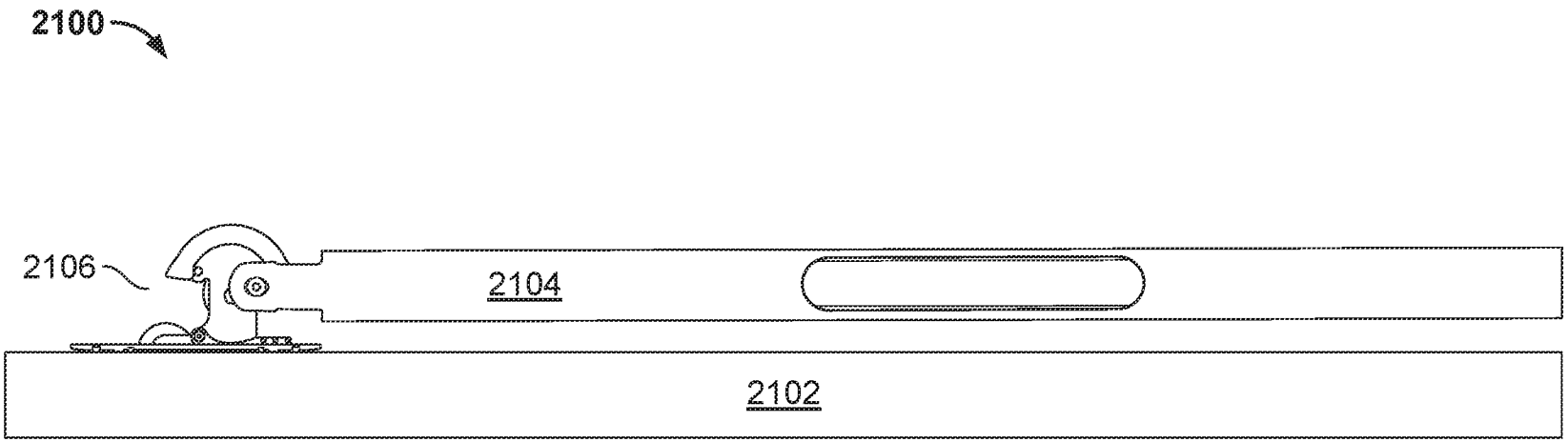
FIG. 22 illustrates an embodiment of an exercise machine component in a storage configuration.

FIG. 22 illustrates an embodiment of an exercise machine component in a storage configuration. As mentioned in FIG. 21, in addition to the five fixed positions, the sagittal gear on the carriage (2106) may include a storage position for the arm (2104), where the bottom stop tip allows the arm (2104) to be parallel or almost parallel to the column (2102).

Figure 23:
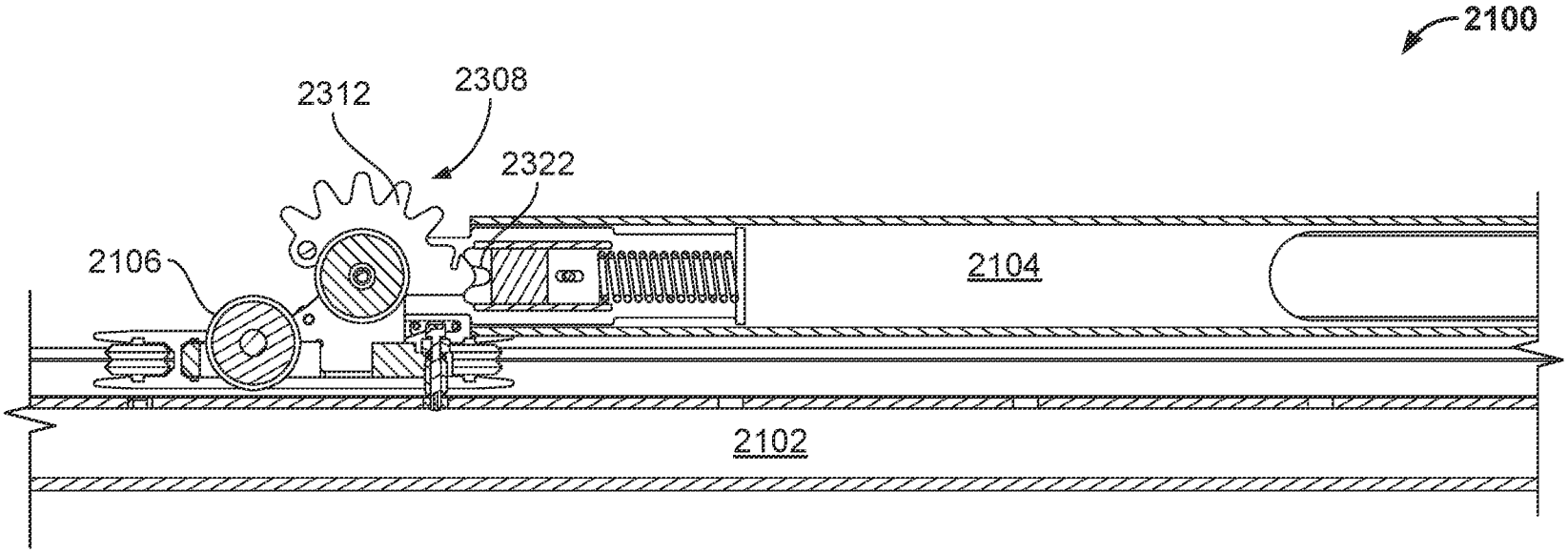
FIG. 23 illustrates a partial sectional view of an embodiment of an exercise machine component in a storage configuration.

FIG. 23 illustrates a partial sectional view of an embodiment of an exercise machine component in a storage configuration. Here, the sagittal gear (2308) with its teeth (2112) on the carriage (2106) may include a storage position for the arm (2104) with locking member (2322), where the bottom stop tip allows the arm (2104) to be parallel or almost parallel to the column (2102).

Figure 24:
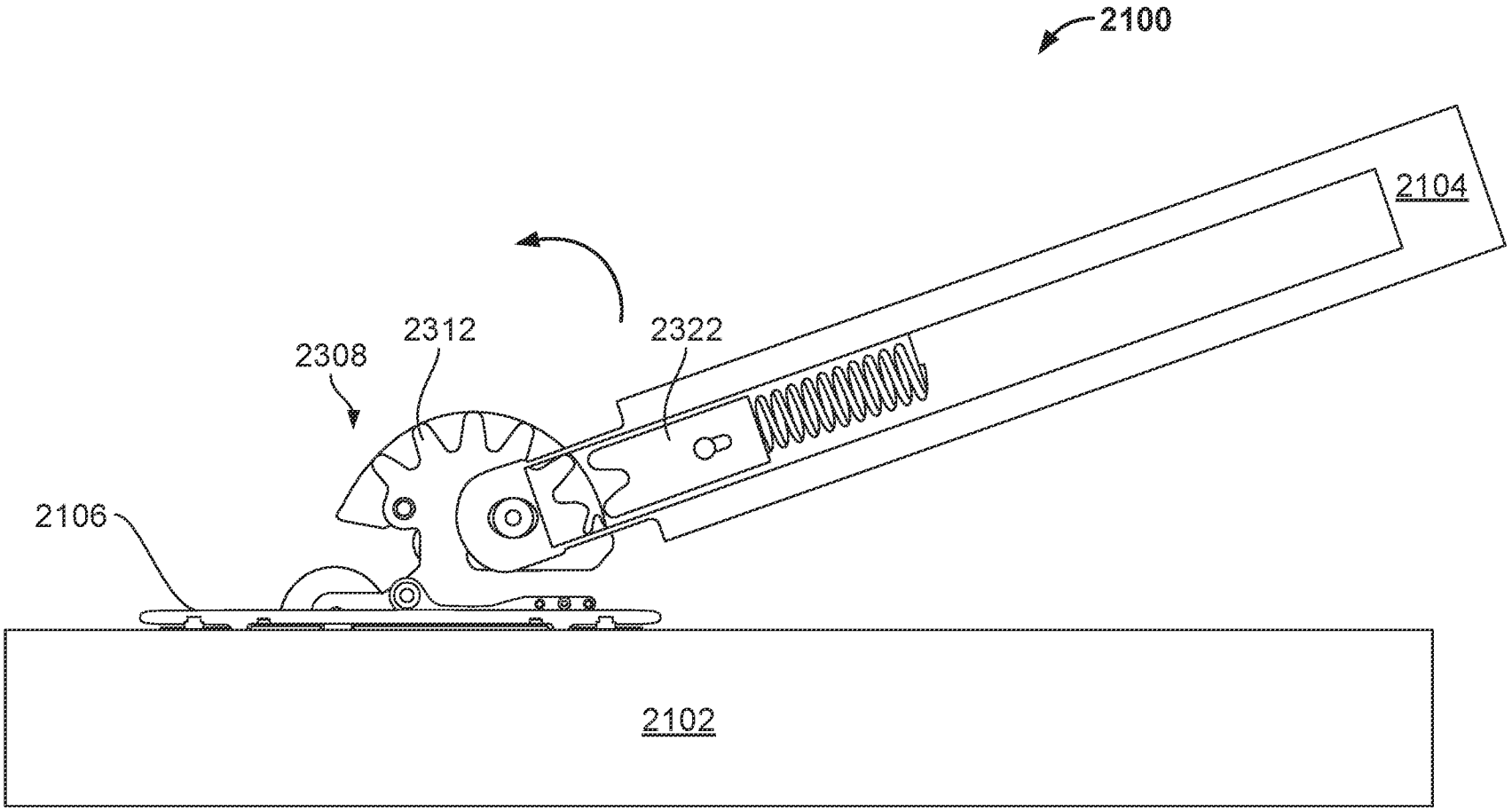
FIG. 24 illustrates a partial sectional view of an embodiment of an exercise machine component transitioning from a storage configuration into a locking position.

FIG. 24 illustrates a partial sectional view of an embodiment of an exercise machine component transitioning from a storage configuration into a locking position. Here, the sagittal gear (2308) with its teeth (2112) on the carriage (2106) is transitioning arm (2104) away from the column (2102), when it was previously parallel to the column (2102).

Figure 25:
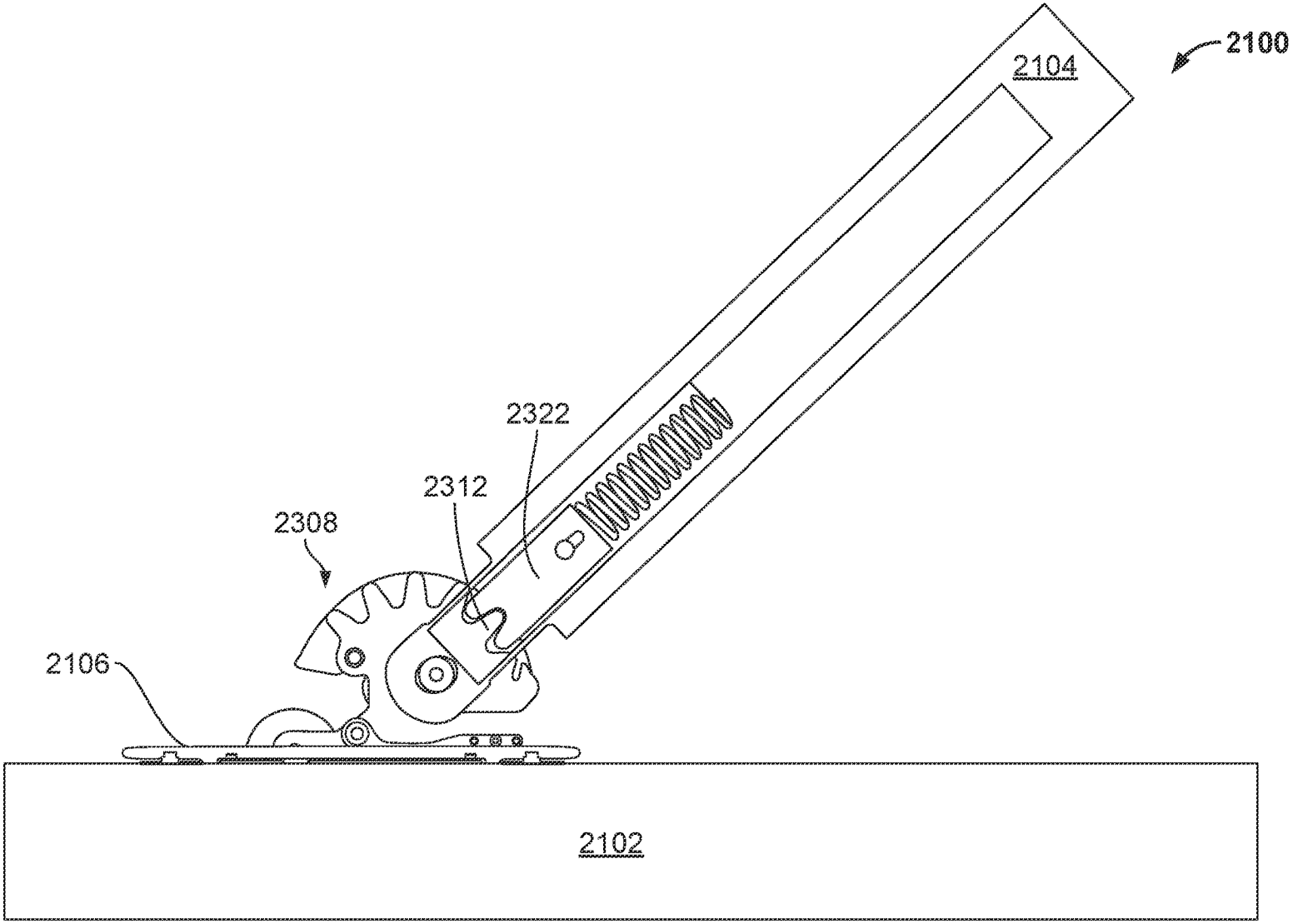
FIG. 25 illustrates a partial sectional view of an embodiment of an exercise machine component secured in a locked position.

FIG. 25 illustrates a partial sectional view of an embodiment of an exercise machine component secured in a locked position. Here, the sagittal gear (2308) with its teeth (2112) on the carriage (2106) are secured with the locking member (2322) on the arm (2104).

Figure 26:
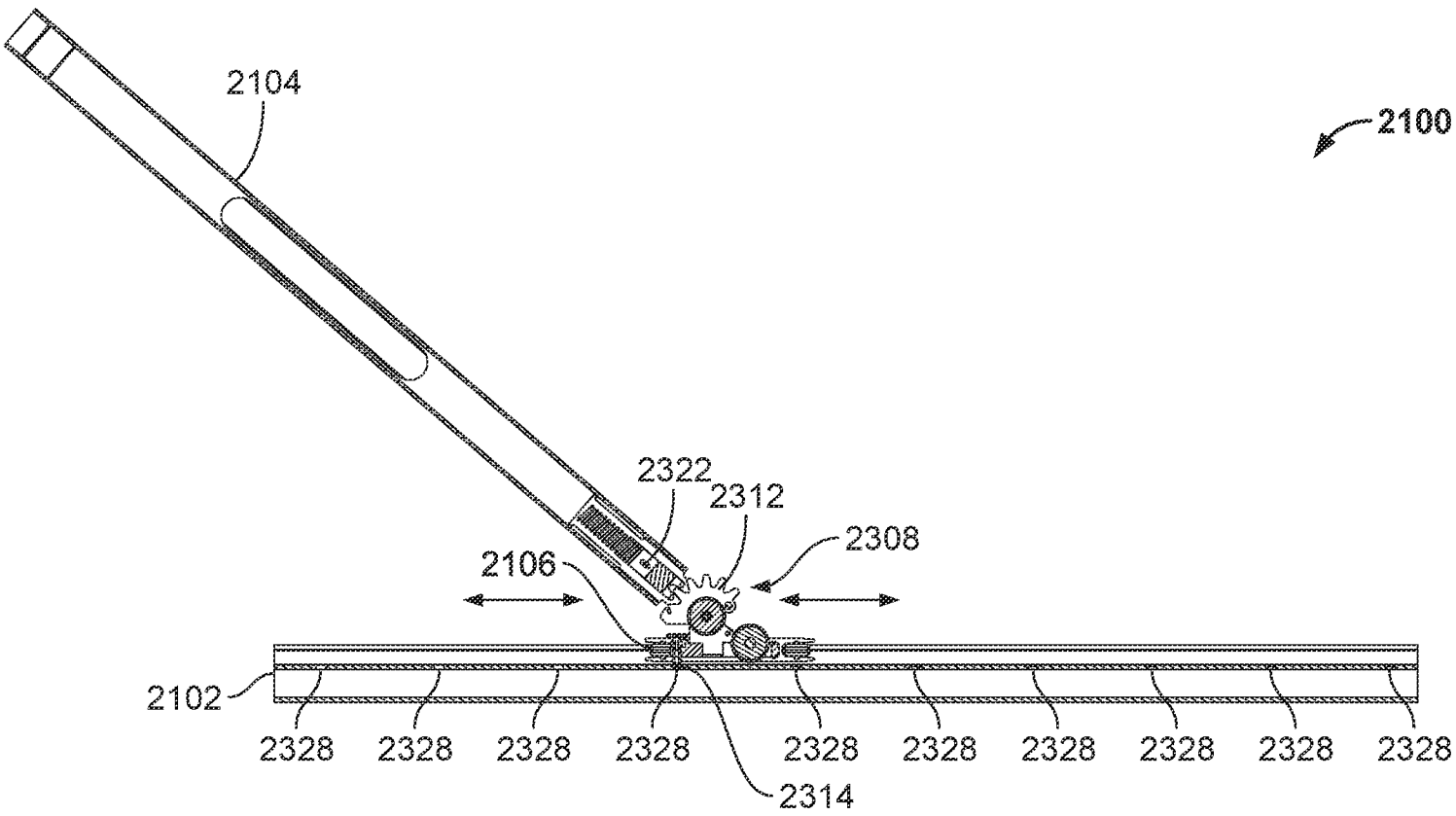
FIG. 26 illustrates a sectional view of an embodiment of an exercise machine component.

FIG. 26 illustrates a sectional view of an embodiment of an exercise machine component. In one embodiment, the arm (2104) and the column carriage (2106) are rotatably coupled to each other through a locking mechanism. that comprises a sagittal gear (2308) with teeth (2312) on the column carriage (2106) and a locking member (2322) within the arm (2104). The column carriage (2106) may be moveably coupled to the column (2102) through the engagements of rollers and a column groove. The column (2102) may include a plurality of notches (2328) that are engageable through the column stop (2314) of the column carriage (2106) forming fixed locking points along the length of the column.

As shown in FIG. 26, the column carriage (2106) may be able to move longitudinally on the column (2102) when the column stop (2314) is disengaged from notches (2328). The position of the notches (2328) on the column (2102) may be set incrementally from one another in accordance with the preferences of a user.

Figure 27:
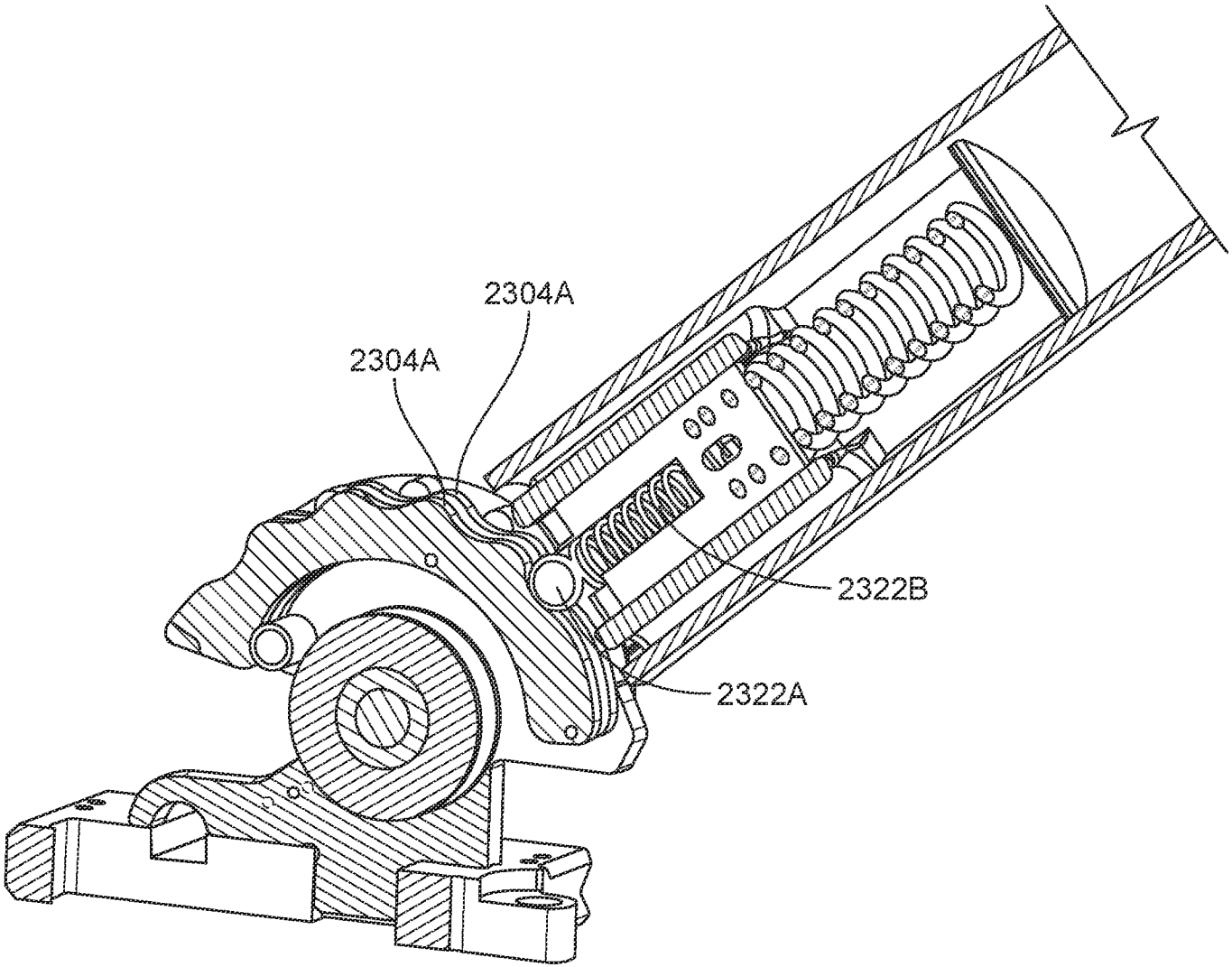
FIG. 27 illustrates a perspective view of an embodiment of a modified gear shroud.

FIG. 27 illustrates a perspective view of an embodiment of a modified gear shroud. In an alternate embodiment, gear shroud (2304) is replaced with modified gear shroud (2304A) to provide smoother haptic feedback to the user. As shown in FIG. 23, modified gear shroud (2304A) connects with locking member roller (2322A) to provide this smoother haptic feedback. In this configuration, locking functionality is decoupled from the haptic feedback. Locking is still performed by the close coupling of teeth (2312) of sagittal gear (2308) with locking member (2322). But now the detent is provided, not by teeth (2312), but rather by modified gear shroud (2304A), and the rolling action over the detent is performed not by locking member (2322) but rather by locking member roller (2322A). Secondary spring (2322B) forces roller (2322A) onto the track formed by the surface of modified gear shroud (2304A). Since this track is unburdened with providing locking functionality, it can be shaped to maximize smoothness of the path, and it can even be located on the outside of arm (2104).

Figure 28A:
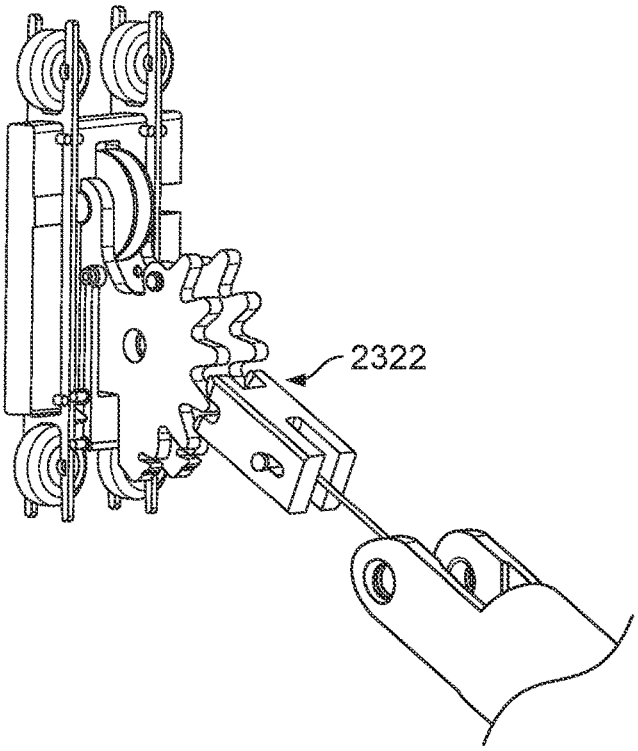
FIG. 28A illustrates a side perspective of an embodiment of a locking member.
Figure 28B:
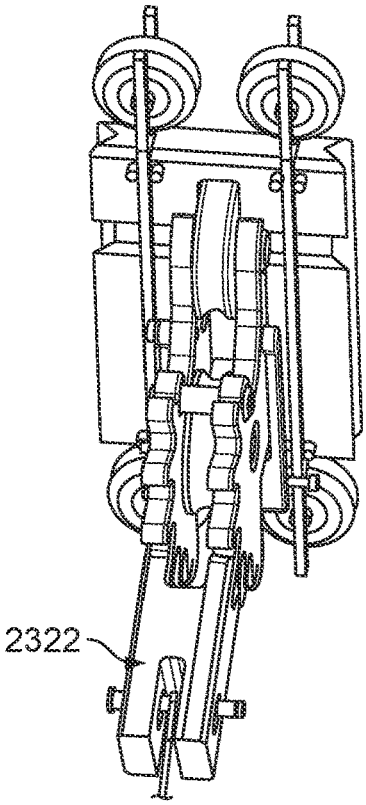
FIG. 28B illustrates a top perspective of an embodiment of a locking member.
Figure 28C:
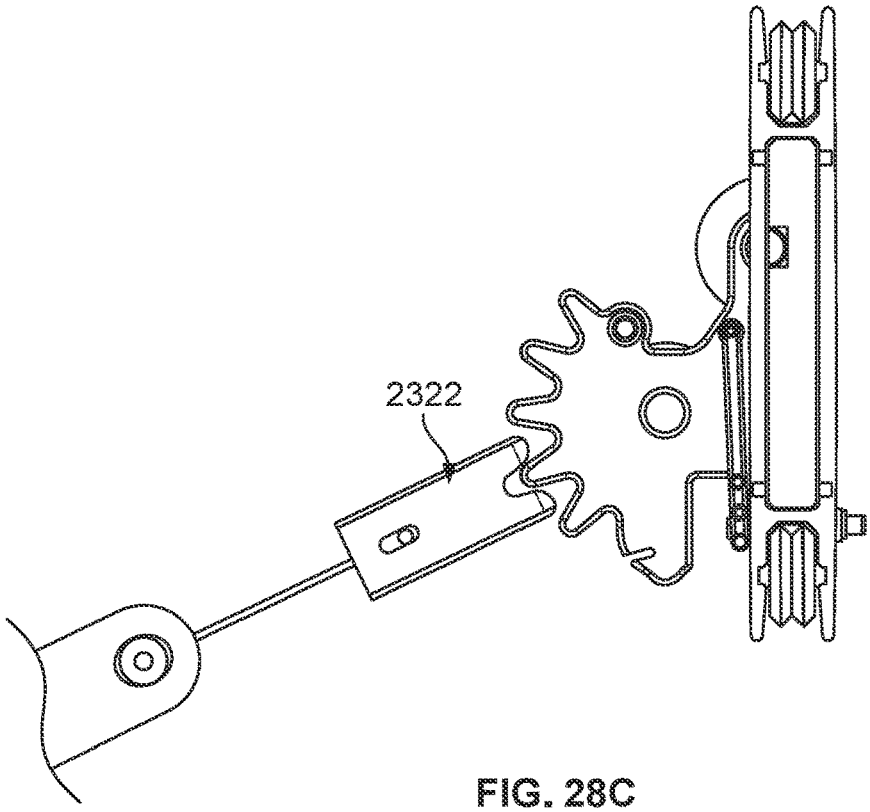
FIG. 28C illustrates a side view of an embodiment of a locking member.

FIG. 28A illustrates a side perspective of an embodiment of a locking member. FIG. 28B illustrates a top perspective of an embodiment of a locking member. FIG. 28C illustrates a side view of an embodiment of a locking member. In each of FIGS. 28A, 28B, and 28C, the locking member (2322) is shown in relation to the sagittal gear.

In one embodiment, the materials from which the parts of exercise machine component (2100) may be made comprise any rigid materials including, without limitation, steel, aluminum, high strength plastic, and carbon fiber. Moreover, these parts can be manufactured using any manufacturing method, including, without limitation, injection molding, casting, machining, forging, and 3D printing.

To summarize, an exercise machine comprising a tiltable arm and a locking gear mechanism on a column carriage to support a discrete number of positions for the tiltable arm is disclosed. The tiltable arm and the gear detent mechanism may have a cable threaded through them forming part of a pulley system to perform pulley-based exercises. The tiltable arm may be supported by the carriage that moves up and down within a rotatable column, thus providing three degrees of freedom for movement of the arm. The locking gear mechanism may include various teeth machined to permit the arm to slide into a fixed position from a storage position without actuating a locking member.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine, comprising:

a load element;

a column;

a carriage configured to engage with the column and travel along the column, wherein the carriage supports a load arm translating vertically along the column, wherein the carriage includes a sagittal gear that includes teeth and a locking member that engages the teeth, wherein the carriage includes a support assembly that includes wheels and springs, wherein the springs comprise spring plates; and the load arm supported by the carriage providing a load path along which a cable is routed from the load element to an actuator wherein the load arm is positioned with at least three degrees of freedom by movement of the carriage along the column, rotation of the column, and tilting of the load arm, wherein the sagittal gear enables the tilting of the load arm at discrete angles, wherein the locking member is engaged to the teeth of the sagittal gear at the discrete angles.

2. The exercise machine as recited in claim 1, wherein the column is designed to be oriented in a substantially vertical direction when the exercise machine is mounted.

3. The exercise machine as recited in claim 1, wherein the column comprises a track.

4. The exercise machine as recited in claim 1, wherein the load arm includes a pulley to route the cable.

5. The exercise machine as recited in claim 1, wherein the carriage includes a support assembly that floats the carriage relative to the column and supports the carriage when the carriage is under load.

6. The exercise machine as recited in claim 1, wherein the carriage includes a support assembly that includes wheels and springs.

7. The exercise machine as recited in claim 1, wherein the spring plates engage to cause the wheels to engage the column in the absence of an external force being applied to the load arm.

8. The exercise machine as recited in claim 1, further including a remote control enabled solenoid that locks rotation of the column.

9. The exercise machine as recited in claim 1, further including a second load arm.

10. The exercise machine as recited in claim 1, wherein movement of the carriage is indexed by an index pin.

11. The exercise machine as recited in claim 1, wherein the load arm includes a handle that when pulled, causes the locking member to be disengaged from the sagittal gear, enabling the arm to tilt vertically.

12. A method of providing exercise resistance comprising:

generating a load using a load element;

coupling the load element to an actuator via:

a column;

a carriage configured to engage with the column and travel along the column, wherein the carriage supports a load arm translating vertically along the column, wherein the carriage includes a sagittal gear that includes teeth and a locking member that engages the teeth, wherein the carriage includes a support assembly that includes wheels and springs, wherein the springs comprise spring plates; and the load arm supported by the carriage providing a load path along which a cable is routed from the load element to the actuator wherein the load arm is positioned with at least three degrees of freedom by movement of the carriage along the column, rotation of the column, and tilting of the load arm, wherein the sagittal gear enables the tilting of the load arm at discrete angles, wherein the locking member is engaged to the teeth of the sagittal gear at the discrete angles.

13. The method of providing exercise resistance as recited in claim 12, wherein the load is coupled to the actuator using a pulley to route the cable.

14. The method of providing exercise resistance as recited in claim 12, wherein the carriage is translated vertically along the column.

15. The method of providing exercise resistance as recited in claim 12, wherein the load arm is tilted with respect to the carriage using the sagittal gear.

* * * * *